US006347196B1

(12) United States Patent
Kawabata et al.

(10) Patent No.: US 6,347,196 B1
(45) Date of Patent: Feb. 12, 2002

(54) IMAGE STICKING REDUCING METHOD AND APPARATUS

(75) Inventors: Takashi Kawabata; Shuji Iseki; Keiji Yamamoto; Naoto Yoshino; Naoto Nishi; Nobuyoshi Komatsu; Yukio Hayashi; Tatsuya Soga; Norio Hokari, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/444,206

(22) Filed: Nov. 22, 1999

(30) Foreign Application Priority Data

Nov. 27, 1998 (JP) ..... 10-338265

(51) Int. Cl.[7] ..... G03G 15/00
(52) U.S. Cl. ..... 399/16; 399/21; 399/397
(58) Field of Search ..... 399/16, 20, 21, 399/397, 398, 302, 315, 22

(56) References Cited

U.S. PATENT DOCUMENTS 3,508,824 A * 4/1970 Leinbach et al. ..... 399/315
3,650,618 A * 3/1972 Volkers ..... 399/22
3,751,156 A * 8/1973 Szostak et al. ..... 399/101
4,073,585 A * 2/1978 Kobayashi et al. ..... 399/22
4,443,101 A * 4/1984 Sakurai et al. ..... 399/22
4,497,569 A * 2/1985 Booth ..... 399/20
5,187,526 A * 2/1993 Zaretsky ..... 399/302
5,280,322 A * 1/1994 Kono ..... 399/22 X
5,502,545 A * 3/1996 Tsuruoka ..... 399/21
5,557,389 A * 9/1996 Sato et al. ..... 399/315

FOREIGN PATENT DOCUMENTS

JP 8-23719 3/1996
JP 8-146707 6/1996

* cited by examiner

*Primary Examiner*—Fred L Braun
(74) *Attorney, Agent, or Firm*—Oliff & Berridge, PLC

(57) ABSTRACT

An apparatus and techniques for reducing the electrostatic sticking of a transfer member to the image carrying body of an image forming apparatus. The visible image on the image carrying body is formed by charged participles. A collective transfer unit collectively transfers the visible image from the image carrying body to a transfer member. A transfer member judging unit judges whether a transfer member exists downstream of and in the vicinity of a transfer position of the collective transfer unit. A pre-stop processing unit for preventing, if the transfer member presence judging unit judges that a transfer monitor exists when the stopping unit stops the device, the transfer member from electrostatically sticking to the image carrying body.

17 Claims, 24 Drawing Sheets

IMAGE STICKING REDUCING METHOD AND APPARATUS

BACKGROUND OF THE INVENTION

1. Field of the Invention

The present invention relates to an image forming apparatus such as an electrophotographic copier. In particular, the invention relates to an improvement of an image forming apparatus of a type in which a visible image such as a full-color image formed on an image carrying body is transferred collectively to a transfer member.

2. Description of the Related Art

For example, an intermediate transfer type color image forming apparatus is known which is equipped with a latent image carrying body such as a photoreceptor drum on which a toner image of each color component corresponding to an electrostatic latent image is formed according to, for example, the electrophotographic scheme, a belt-like or drum-like intermediate transfer body to which each toner image on the latent image carrying body is transferred intermediately, a first transfer device for sequentially transferring toner images on the latent image carrying body to the intermediate transfer body, and a second transfer device (collective transfer device) for performing collective second transfer, on a transfer member such as a sheet, of the toner images that have been transferred to the intermediate transfer body (refer to Japanese Patent Application Laid-Open No. 5-323704 (1993), for example).

For example, a transfer roller is used as the second transfer device. The transfer roller gives a transfer member charges of the opposite polarity to the toner charging polarity, thereby transferring toner images formed on the intermediate transfer body to the transfer member by electrostatic force.

One example technique for peeling a transfer member from the intermediate transfer body after toner images of the respective color components on the intermediate transfer body have been transferred to the transfer member is a method of forcibly peeling the transfer member by bringing a peeling nail into sliding contact with the intermediate transfer body. Another method is available in which a peeling charge elimination device (e.g., a separation corotron) is provided downstream of the second transfer position and a transfer member is peeled by weakening the electrostatic adsorption force of the transfer member by eliminating charges from the transfer member through an AC corona discharge that is caused by the peeling charge elimination device (refer to Japanese Patent Application Laid-Open No. 8-146707 (1996), for example).

However, the technique in which the peeling nail, for example, is used to peel a transfer member from the intermediate transfer body has a technical problem that a transfer member and the intermediate transfer body are prone to formation of a scratch.

On the other hand, the technique using the peeling charge elimination device has a problem that when charges are eliminated from a transfer member after a second transfer, the amount of charge on the transfer member decreases and the electrostatic adsorption force between toner images on the transfer member and the transfer member is lost, causing toner scattering.

To solve the above problems, a method has already been proposed in which a conductive peeling plate is provided, for example, downstream of the second transfer position. A transfer member is peeled by utilizing a phenomenon that when the transfer member approaches the peeling plate after passing the second transfer position, charges that are reverse in polarity to charges that have been given to the transfer member at the second transfer position are induced on the peeling plate and hence the transfer member is electrostatically adsorbed on the peeling plate (refer to Japanese Patent Publication No. 8-23719 (1996), for example).

However, even in this type of apparatus, if the volume resistivity of the intermediate transfer body becomes, for example, 12 Log Ω·cm or larger because of variations of electric characteristic values of the material of the intermediate transfer body due to environmental variations (i.e., variations in temperature and humidity), after a second transfer a transfer member is given negative charges through a peeling discharge between the transfer member and the intermediate transfer body and positive charges that have been induced by electrostatic polarization remain on the surface of the intermediate transfer body.

At this time, if the volume resistivity of the intermediate transfer body is high, the potential of the surface of the intermediate transfer body becomes, for example, +2,000 V or more and, in addition, the increased volume resistivity markedly elongates the time that is taken until the charges on the intermediate transfer body decrease sufficiently. This results in fear that the electrostatic adsorption force acting on the transfer member that is caused by charges on the intermediate transfer body becomes stronger than the electrostatic adsorption force cased by charges induced on the conductive peeling plate that is provided close to and downstream of the second transfer portion, whereby the transfer member is kept stuck to the intermediate transfer body, that is, a peeling failure occurs.

As described above, after a second transfer the intermediate transfer body continues to hold an electric field in such a direction as to attract a transfer member.

At this time, if a transfer member jams at a location other than the second transfer position, there is a possibility, depending on the timing, that a transfer member is located in a region where a portion of the intermediate transfer body that has been subjected to a second transfer is charged.

In such circumstances, there is fear that the transfer member that has once been peeled from the intermediate transfer body again sticks to the charged portion of the intermediate transfer body.

Conventional image forming apparatuses have no means for preventing such re-sticking of a transfer member; once a transfer member is re-stuck to the intermediate transfer body, it is difficult for a user to realize that fact.

Therefore, there is fear that if such re-sticking of a transfer member occurs, a user does not realize it and the transfer member is transported being stuck to the intermediate transfer body, resulting in a jam at a location that the user is hard to reach to remove the jammed transfer member such as the position of an intermediate transfer body cleaner.

In particular, the possibility of occurrence of the phenomenon of re-sticking of a transfer member to the intermediate transfer body is higher in the case of a transfer member that is easily bent or a transfer member having an extremely large resistivity value (e.g., second-surface copying of a double-sided copying operation in a low-temperature, low-humidity environment).

Although as described above the above technical problems are remarkable in intermediate transfer type image forming apparatus, those problems also occurs in, for example, image forming apparatuses of a type in which a toner image on a photoreceptor belt is directly transferred to a transfer member.

SUMMARY OF THE INVENTION

The present invention has been made to solve the above problems in the art, and provides an image forming apparatus which effectively prevents a transfer member from re-sticking to an image carrying body at the occurrence of an abnormality such as a jam.

As shown in FIG. 1, the image forming apparatus has an image carrying body 1 for carrying a visible image formed by charged particles, a collective transfer unit 2 for collectively transferring the visible image on the image carrying body 1 to a transfer member 3, a stopping unit 4 for stopping devices during image formation, a transfer member presence judging unit 5 for judging whether the transfer member 3 exists downstream of and in the vicinity of a transfer position of the collective transfer unit 2, and a pre-stop processing unit 6 for preventing, if the transfer member presence judging unit 5 judges that the transfer member 3 exists when the stopping unit 4 stops the devices, the transfer member 3 from electrostatically sticking to the image carrying body 1.

The image forming scheme that is employed in the image forming apparatus according to the invention may be the electrophotographic scheme, the electrostatic recording scheme, or other proper schemes. Either a single or multiple image carrying bodies 1 may be used to form images of respective color components.

The image carrying body 1 may be belt-like or drum-like as long as it can carry a visible image. The form of the image carrying body 1 may be selected as desired from among various forms. For example, naturally, the image carrying body 1 may be formed by only an image formation carrying body 1*a* made of a photosensitive material or a dielectric. Alternatively, the image carrying body 1 may have such an image formation carrying body 1*a* and a belt-like or drum-like intermediate transfer body 1*b* which a visible image on the image formation carrying body 1*a* is transferred to and held on temporarily.

The collective transfer unit 2 may be of the transfer roller type, the corotron type, or other proper types as long as it has a function of transferring a visible image on the image carrying body 1 to the transfer member 3. However, from the viewpoint of easiness in controlling a transfer electric field, the transfer roller type is preferable in which case a transfer electric field can be controlled in a narrow range.

The stopping unit 4 maybe of any type as long as it forcibly stops devices at the occurrence of an abnormality such as a jam. The time points when the respective devices are stopped need not always be the same. Usually, a device where an abnormality such as a jam has occurred is stopped immediately and devices on which the pre-stop processing unit 6 act are stopped later than the other devices.

The transfer member presence judging unit 5 may be of any type as long as it judges whether the transfer member 3 exists downstream of and in the vicinity of the transfer position of the collective transfer unit 2. An affirmative judgment is made not only in a state that the rear edge of the transfer member 3 has passed the transfer position of the collective transfer unit 2 but also in a state that the transfer member 3 is passing the transfer position of the collective transfer unit 2.

The transfer member presence judging unit 5 may be selected as desired from among various types. For example, the transfer member presence judging unit 5 may be such that one or more position sensors for detecting the front edge or rear edge of the transfer member 3 are disposed in its transport path and the presence of the transfer member 3 is directly judged based on signals supplied from the respective position sensors. Alternatively, the presence of the transfer member 3 may be judged by recognizing the position of the transfer member 3 by using a timer and a signal that is supplied from a prescribed position sensor.

The pre-stop processing unit 6 may be of any type as long as it prevents, if the transfer member presence judging unit 5 judges that the transfer member 3 exists downstream of and in the vicinity of the transfer position of the collective transfer unit 2 when the stopping unit 4 stops devices, the transfer member 3 from electrostatically sticking to the image carrying body 1.

A specific example of the pre-stop processing unit 6 is an electric field attraction unit for attracting, by means of an electric field, the transfer member 3 in the direction that it goes away from the image carrying body 1.

In this case, for example, the electric field attraction unit as the pre-stop processing unit 6 applies a prescribed bias to a constituent member of the collective transfer unit 2 or a member that is disposed downstream of and in the vicinity of the transfer position of the collective transfer unit 2.

In the mode in which the electric field attraction unit as the pre-stop processing unit 6 applies the prescribed bias to the constituent member of the collective transfer unit 2, it is preferable to generate an electric field that acts in the direction that is reverse to the direction of a transfer electric field of the collective transfer unit 2.

In this mode, even if the transfer member 3 that has passed the transfer position of the collective transfer unit 2 is charged negatively, for example, a portion of the image carrying body 1 that has passed the transfer position of the collective transfer unit 2 can also be charged negatively, for example. Therefore, the rear end portion of the transfer member 3 and the image carrying body 1 repel each other in a region downstream of the transfer position of the collective transfer unit 2, whereby the transfer member 3 is prevented from sticking to the image carrying body 1.

In the mode in which the electric field attraction unit as the pre-stop processing unit 6 applies the prescribed bias to the member that is disposed downstream of and in the vicinity of the transfer position of the collective transfer unit 2, from the viewpoint of effectively preventing disorder in a transferred image on the transfer member 3, it is preferable that the prescribed bias has the same polarity as the charging polarity of the transferred image on the transfer image 3.

The member disposed downstream of and in the vicinity of the transfer position of the collective transfer unit 2 means a guide member (exit chute) for guiding the transfer member 3 to a transport member that is disposed upstream of a fusing unit or a peeling member such as a peeling plate for peeling the transfer member 3.

In this mode, when the bias having the same polarity as the charging polarity of a transferred image on the transfer member 3 is applied to the member disposed downstream of and in the vicinity of the transfer position of the collective transfer unit 2, charges having the polarity that is reverse to the charging polarity of the transferred image on the transfer member 3 are induced on the back surface of the transfer member 3 that is a dielectric and hence the transfer member 3 is attracted electrostatically by the member that is closer to the transfer member 3 than the image carrying body 1 is. Therefore, the transfer member 3 is prevented from sticking to the image carrying body 1.

Further, since charges of the polarity that is reverse to the charging polarity of the transferred image are induced on the back surface of the transfer member 3, the transferred image on the front surface of the transfer member 3 is held by the above-described induced charges and there is no fear that disorder occurs in the transferred image.

Another example of the pre-stop processing unit 6 is such that the image carrying body 1 is idled by a prescribed amount after the action of the transfer field of the collective transfer unit 2 is canceled.

In this example, even if the transfer member 3 that has passed the transfer position of the collective transfer unit 2 is charged negatively, for example, a portion of the image carrying body 1 that has passed the transfer position of the collective transfer unit 2 is rendered in a non-charged state. Therefore, electrostatic attractive force is hard to act between the rear end portion of the transfer member 3 and the image carrying body 1 in a region downstream of the transfer position of the collective transfer unit 2, and the transfer member 3 is made so much less prone to stick to the image carrying body 1.

Still another example of the pre-stop processing unit 6 is such that the transfer member 3 is transported toward the downstream side of the transfer position of the collective transfer unit 2 until the rear end portion of the transfer member 3 completely passes the transfer position of the collective transfer unit 2 and reaches a position having a prescribed distance from the transfer position.

In this example, the pre-stop processing unit 6 may stop the image carrying body 1 first at a time point when the rear end portion of the transfer member 3 has passed the transfer position of the collective transfer unit 2. However, from the viewpoint of simplification of control, it is preferable to stop the image carrying body 1 after completion of the operation of transporting the transfer member 3.

In this example, since the rear end portion of the transfer member 3 is located at a position that is sufficiently distant from a charged portion of the image carrying body 1, electrostatic attractive force is hard to act between the rear end portion of the transfer member 3 and the image carrying body 1 in a region downstream of the transfer position of the collective transfer unit 2 and the transfer member 3 is made so much less prone to stick to the image carrying body 1.

A further example of the pre-stop processing unit 6 is such that the image carrying body 1 is rotated in the reverse direction by a prescribed amount on condition that the rear end portion of the transfer member 3 has passed the transfer position of the collective transfer unit 2.

In this case, the rotation amount of the image carrying body 1 in the reverse direction may be set at a proper value that is in such a range that the transfer member 3 that is located downstream of the transfer position of the collective transfer unit 2 and a charged portion of the image carrying body 1 are made sufficiently distant from each other and do not influence each other.

In this example, even if the transfer member 3 that has passed the transfer position of the collective transfer unit 2 is charged negatively, for example, by virtue of the reverse rotation of the image carrying body 1 a charged portion of the image carrying body 1 is sufficiently separated from the transfer member 3. In this state, since the image carrying body 1 has no charged portion that is opposed to the rear end portion of the transfer member 3 in a region downstream of the transfer position, electrostatic attractive force is hard to act between the rear end portion of the transfer member 3 and the image carrying body 1 and hence the transfer member 3 is made so much less prone to stick to the image carrying body 1.

As for the timing of the start of operation of the pre-stop processing unit 6, the pre-stop processing unit 6 may always operate if the transfer member 3 exists downstream of and in the vicinity of the transfer position of the collective transfer unit 2. However, in view of the fact that the easiness of re-sticking of the transfer member 3 to the image carrying body 1 depends on the use conditions (the environment condition, the type of transfer member 3, the image formation mode, etc.) of the transfer member 3, from the viewpoint of performing an efficient control, the pre-stop processing unit 6 may start to operate when it is judged, in consideration of the use conditions of the transfer member 3, that a condition is established that the transfer member 3 tends to re-stick to the image carrying body 1.

Next, the operation of the above-described image forming apparatus will be described below.

Referring to FIG. 1, the stopping unit 4 stops devices during image formation. If the transfer member presence judging unit 5 judges that the transfer member 3 exists downstream of and in the vicinity of the transfer position of the collective transfer unit 2, the pre-stop processing unit 6 operates basically and prevents the transfer member 3 located downstream of and in the vicinity of the transfer position of the collective transfer unit 2 from electrostatically sticking to the image carrying body 1 when the stopping unit 4 stops the devices.

BRIEF DESCRIPTION OF THE DRAWINGS

Preferred embodiments of an image forming apparatus according to the present invention are now described in detail based on the following drawings.

DETAILED DESCRIPTION OF THE PREFERRED EMBODIMENTS

The present invention will be hereinafter described in detail by using embodiments that are illustrated by the accompanying drawings.

Embodiment 1

Figure 1:
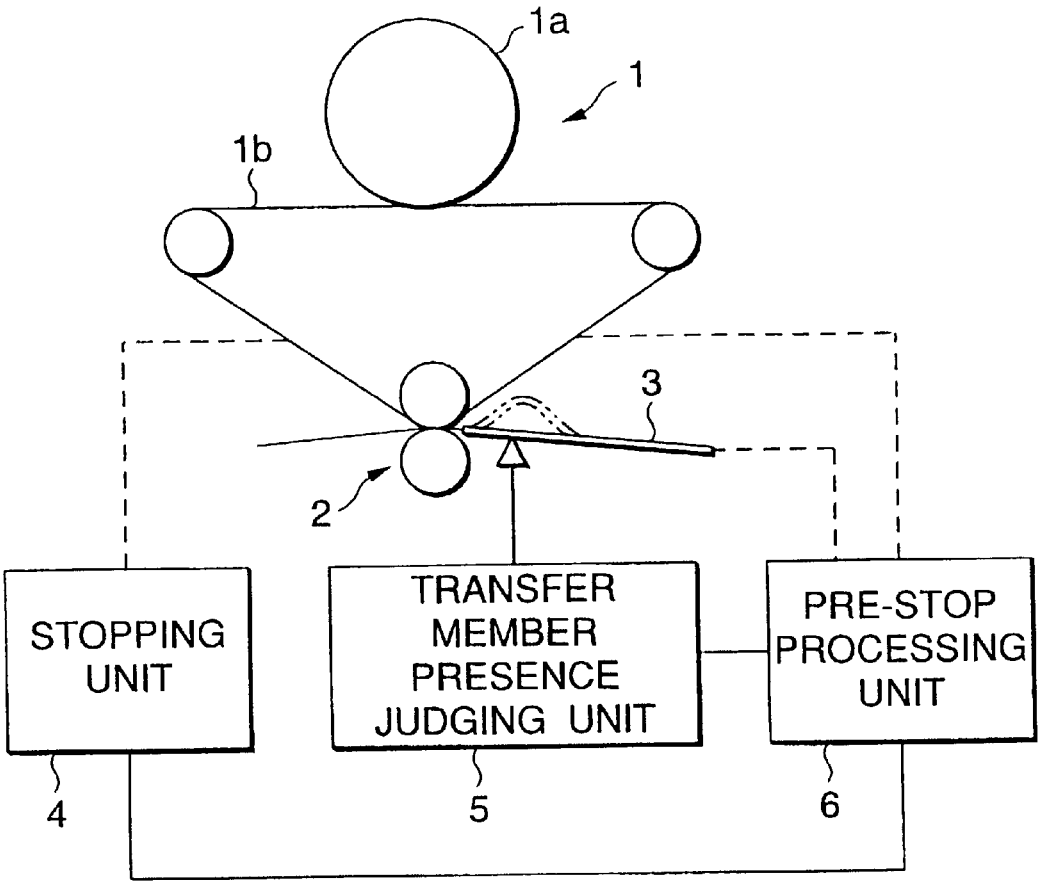
FIG. 1 outlines an image forming apparatus according to the present invention.
Figure 2:
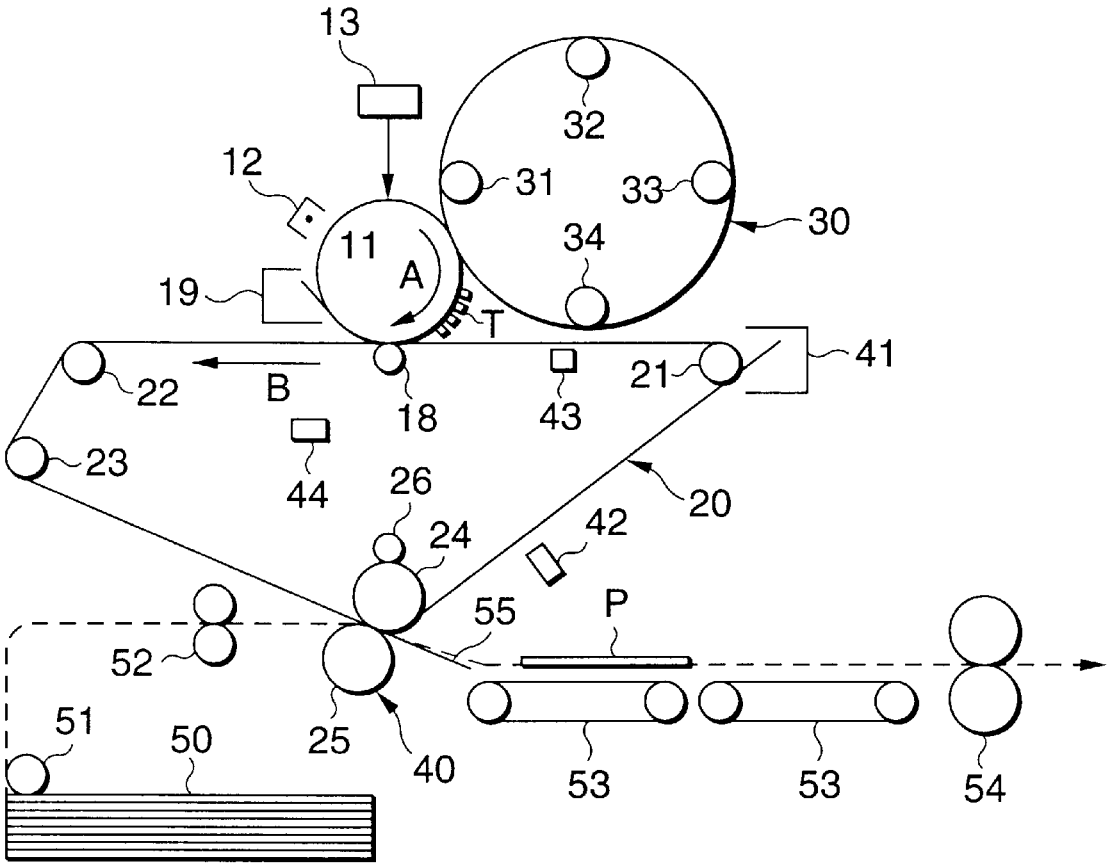
FIG. 2 shows a color image forming apparatus according to a first embodiment of the invention.

FIG. 2 shows a general configuration of a color image forming apparatus (color electrophotographic copier) to which the invention is applied.

In FIG. 2, reference numeral 11 denotes a photoreceptor drum (latent image carrying body). A latent image corresponding to image information is formed on the surface of the photoreceptor drum 11 by a charging device 12, an exposing device 13 such as a laser scanning device, and other devices according to a known electrophotographic process while the photoreceptor drum 11 rotates in the direction of arrow A.

For example, a rotary developing device 30 is disposed in the vicinity of the photoreceptor drum 11. The rotary holder of the rotary developing device 30 is mounted with developers 31 to 34 corresponding to respective colors of black (Bk), yellow (Y), magenta (M), and cyan (C). A toner image T is formed by developing each electrostatic latent image formed on the photoreceptor drum 11 by the corresponding one of the developers 31 to 34.

Reference numeral 19 denotes a drum cleaner for removing residual toner on the photoreceptor drum 11.

Reference numeral 20 denotes an intermediate transfer belt (intermediate transfer body) that is disposed to as to be in contact with the surface of the photoreceptor drum 11. Tensely wound on multiple (four in this embodiment) rollers 21 to 24, the intermediate transfer belt 20 rotates in the direction of arrow B. In this embodiment, the four rollers are a drive roller 21 for the intermediate transfer belt 20, a follower roller 22, a tension roller 23 for controlling the tension of the intermediate transfer belt 20 to keep it constant, and a second transfer counter roller (backup roller) 24.

In this embodiment, the intermediate transfer belt 20 is formed by adding a proper amount of carbon black or the like to a resin such as polyimide, polycarbonate, polyester, polypropylene, or polyethylene terephthalate or one of various kinds of rubber so that it has volume resistivity of $10^6$ to $10^{14}$ Ω·m. The thickness of the intermediate transfer belt 20 is set at 0.1 mm, for example.

A first transfer device (in this embodiment, a first transfer roller) 18 is disposed on the back surface side of the intermediate transfer belt 20 at the position (first transfer position) where the intermediate transfer belt 20 is opposed to the photoreceptor drum 11. A toner image T on the photoreceptor drum 11 is electrostatically attracted by the intermediate transfer belt 20 by applying a voltage whose polarity is reverse to the toner charging polarity.

A second transfer device 40 is disposed at a second transfer position where the intermediate transfer belt 20 is opposed to a transport path of a sheet P as a transfer member. In this embodiment, the second transfer device 40 has a second transfer roller (bias roller) 25 that is pressed against the toner image carrying surface of the intermediate transfer belt 20 and a counter roller (backup roller) 24 that is disposed on the back side of the intermediate transfer belt 20 and serves as a counter electrode for the second transfer roller 25.

Figure 3:
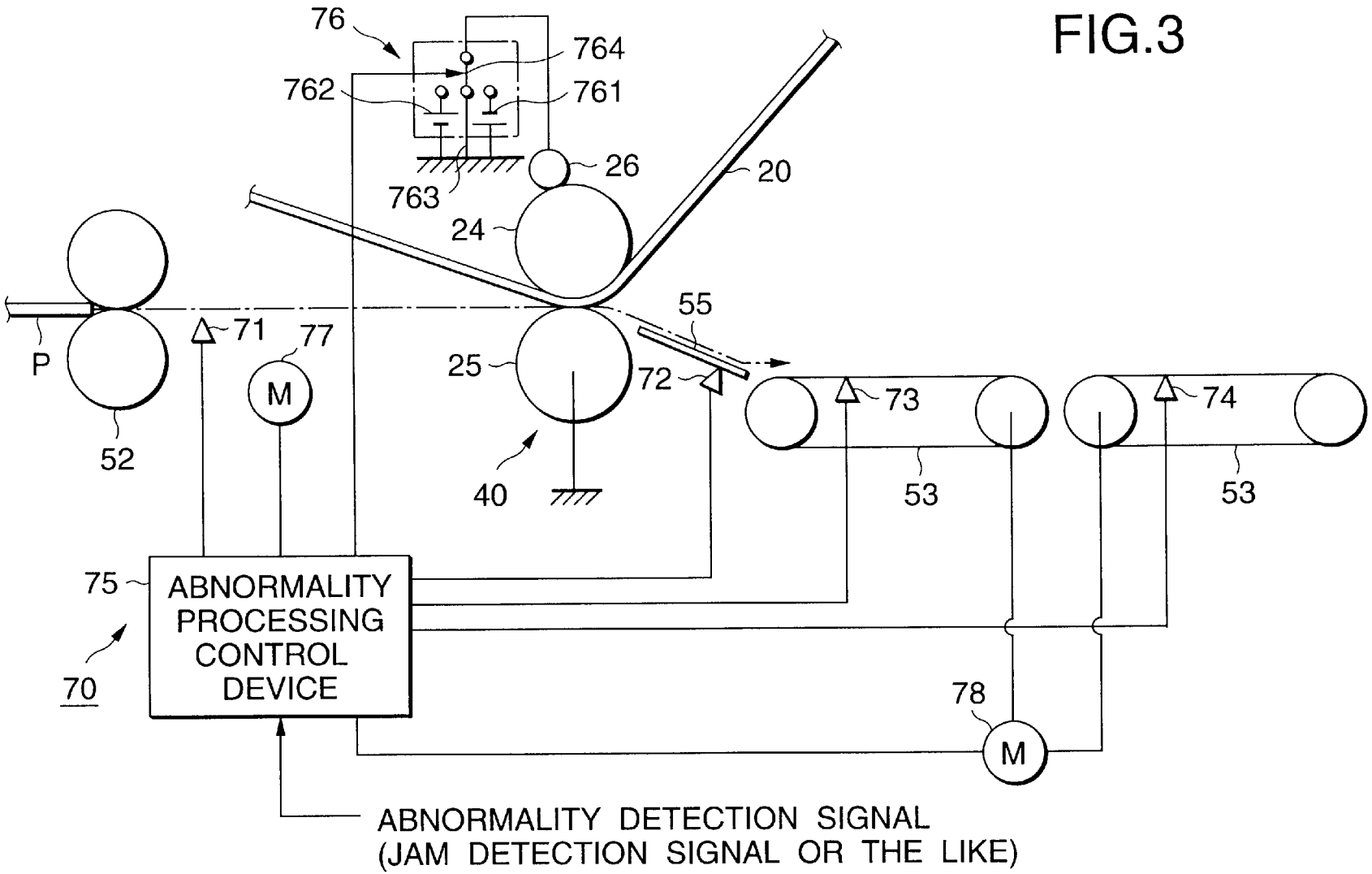
FIG. 3 shows an abnormality processing control system according to the first embodiment.

In this embodiment, as shown in FIG. 3, the bias roller 25 is grounded and a bias having the same polarity as the toner charging polarity is stably applied to the backup roller 24 via electricity feed roller 26.

In this embodiment, the surface portion of the backup roller 24 is a tube made of a blended rubber of EPDM and NBR having carbon dispersed therein and its internal portion is made of EPMD rubber. The backup roller 24 is so formed as to have surface resistivity of $10^7$ to $10^{10}$ Ω/□ and a roller diameter of 28 mm. Its hardness is set at 70° (ASKER hardness C-type), for example.

On the other hand, the surface portion of the bias roller 25 is a tube of carbon-dispersed urethane rubber and its internal portion is made of carbon-dispersed foamed urethane rubber. A fluorocarbon coating is formed on the surface of the bias roller 25. The bias roller 25 is so formed as to have volume resistivity of $10^3$ to $10^{10}$ Ω·cm and a roller diameter of 28 mm. Its hardness is set at 30° (ASKER hardness C-type), for example.

A belt cleaner 41 for removing residual toner on the intermediate transfer belt 20 is disposed downstream of the second transfer device 40.

A surface potential sensor 42 for detecting the surface potential of the intermediate transfer belt 20 is disposed downstream of the second transfer device 40 and upstream of the belt cleaner 41 on the front surface (toner image carrying surface) side of the intermediate transfer belt 20 so as to be opposed to it.

For example, the surface potential sensor 42 is an ESV (electrostatic voltmeter). In this embodiment, the surface potential sensor 42 is usually used to control, for example, the development conditions and the transfer conditions by monitoring the surface potential of the intermediate transfer belt 20. The surface potential sensor 42 is also used as a sheet presence sensor for detecting whether a sheet P is stuck to the intermediate transfer belt 20 after a second transfer.

A position detection sensor 43 and an environment sensor 44 are disposed in the vicinity of the intermediate transfer belt 20.

In this embodiment, for example, the position detection sensor 43 is a sensor that optically detects a reference mark (position detection mark; not shown) of the intermediate transfer belt 20. For example, the environment sensor 44 is a humidity sensor that detects the humidity inside the machine.

In this embodiment, the sheet feeding system is configured in such a manner that a sheet P is sent out from a paper tray 50 by a feed roller 51, temporarily stopped for positioning by registration rollers 52, and then supplied to the second transfer position with prescribed timing. A sheet P that has been subjected to a second transfer is guided to, for example, a pair of transport belts 53 (in this example, a vacuum transport scheme is employed) via an exit chute 55 and transported to a fusing device 54.

The exit chute 55 is a conductive metal plate, for example, and is grounded.

In particular, in this embodiment, an abnormality processing control system 70 for performing a control of stopping devices when an abnormality such a jam has occurred.

For example, the abnormality processing control system 70 is configured as shown in FIG. 3. A position sensor 71 (e.g., a reflection-type photosensor) for detection of passage of the front edge or rear edge of a sheet P is disposed, for example, immediately downstream of the exit of the registration rollers 52. Position sensors 72 to 74 (e.g., a reflection-type photosensors) for detection of passage of the front edge or rear edge of a sheet P are disposed close to the exit chute 55 and the pair of transport belts 53, respectively. An abnormality detection signal such as a jam detection signal and outputs of the respective position sensors 71 to 74 are captured by an abnormality processing control device 75. Executing, for example, a process shown in FIGS. 4 and 5, the abnormality processing control device 75 controls a bias voltage source 76 that is connected to the electricity feed roller 26, a drive motor 77 for the intermediate transfer belt 20, a drive motor 78 for the pair of transport belts 53, and other devices.

In this embodiment, for example, as shown in FIG. 3, the bias voltage source 76 has a first voltage source 761 for supplying a second transfer bias (in this example a bias (e.g., −2 to −3 kV) having the same polarity (negative polarity) as the toner charging polarity) and a second voltage source 762 for supplying a sticking prevention bias (in this example, a bias (e.g., +2 to +3 kV) having the polarity (positive polarity) reverse to the toner charging polarity) for preventing a sheet P from sticking to the intermediate transfer belt 20. A changeover rotary switch 764 performs switching and selection among the first voltage source 761, the second voltage source 762, and the ground 763.

Next, the operation of the color image forming apparatus according to this embodiment will be described.

A prescribed image forming process is started when a start switch (not shown) is on-manipulated.

Specifically, if an electrostatic latent image that is written onto the photoreceptor drum 11 corresponds to yellow image information, the electrostatic latent image is developed by the developer 32 containing a yellow (Y) toner and a yellow toner image T is formed on the photoreceptor drum 11.

The unfixed toner image T formed on the photoreceptor drum 11 is electrostatically transferred to the surface of the intermediate transfer belt 20 by the first transfer roller 18 at the first transfer position where the photoreceptor drum 11 is in contact with the intermediate transfer belt 20.

Where a monochrome image is to be formed, the toner image T that has been first-transferred to the intermediate transfer belt 20 is immediately second-transferred to a sheet P. On the other hand, where a color image is to be formed by superimposing toner images of plural colors one on another, steps of forming a toner image T on the photoreceptor drum 11 and first-transferring the toner image T are repeated number-of-color times.

For example, in the case of forming a full-color image by superimposing toner images of four colors one on another, yellow, magenta, cyan, and black toner images T are formed on the photoreceptor drum 11 for its respective rotations. The toner images T are sequentially first-transferred to the intermediate transfer belt 20. On the other hand, the intermediate transfer belt 20 rotates at the same period as the photoreceptor drum 11 while holding the yellow toner image T that has been first-transferred first. Then, for respective rotations of the intermediate transfer belt 20, the magenta, cyan, and black toner images T are superimposed one after another on the intermediate transfer belt 20, that is, on the yellow toner image T, at prescribed positions that are determined by the position detection sensor 43.

The toner images T thus first-transferred to the intermediate transfer belt 20 are transported to the second transfer position as the intermediate transfer belt 20 rotates.

On the other hand, a sheet P is sent out from the paper tray 50 by the feed roller 51, supplied to the second transfer position with proper timing by the registration rollers 52, and then interposed between the bias roller 25 and the intermediate transfer belt 20.

At the second transfer position, the toner images T that are carried by the intermediate transfer belt 20 are electrostatically transferred to the sheet P at the second transfer position by action of a transfer electric field that is formed between the bias roller 25 and the backup roller 24 that constitute the second transfer device 40.

The sheet P to which the unfixed toner images T have been transferred is peeled from the intermediate transfer belt 20 and sent to the fusing device 54 by means of the exit chute 55 and the transport belts 53 that are disposed downstream of the second transfer position. The unfixed toner images T are fused by the fusing device 54.

On the other hand, residual toner is removed, by the belt cleaner 41, from the intermediate transfer belt 20 with which the second transfer of the unfixed toner images T have finished.

The bias roller 25 of the second transfer device 40 and the belt cleaner 41 are disposed so as to be able to contact to and separate from the intermediate transfer belt 20. Where a color image is formed, they are separated from the intermediate transfer belt 20 until an unfixed toner image of the last color is first-transferred to the intermediate transfer belt 20.

Next, a process that is executed by the abnormality processing control system 70 at the occurrence of an abnormality such as a jam will be described.

Figure 4:
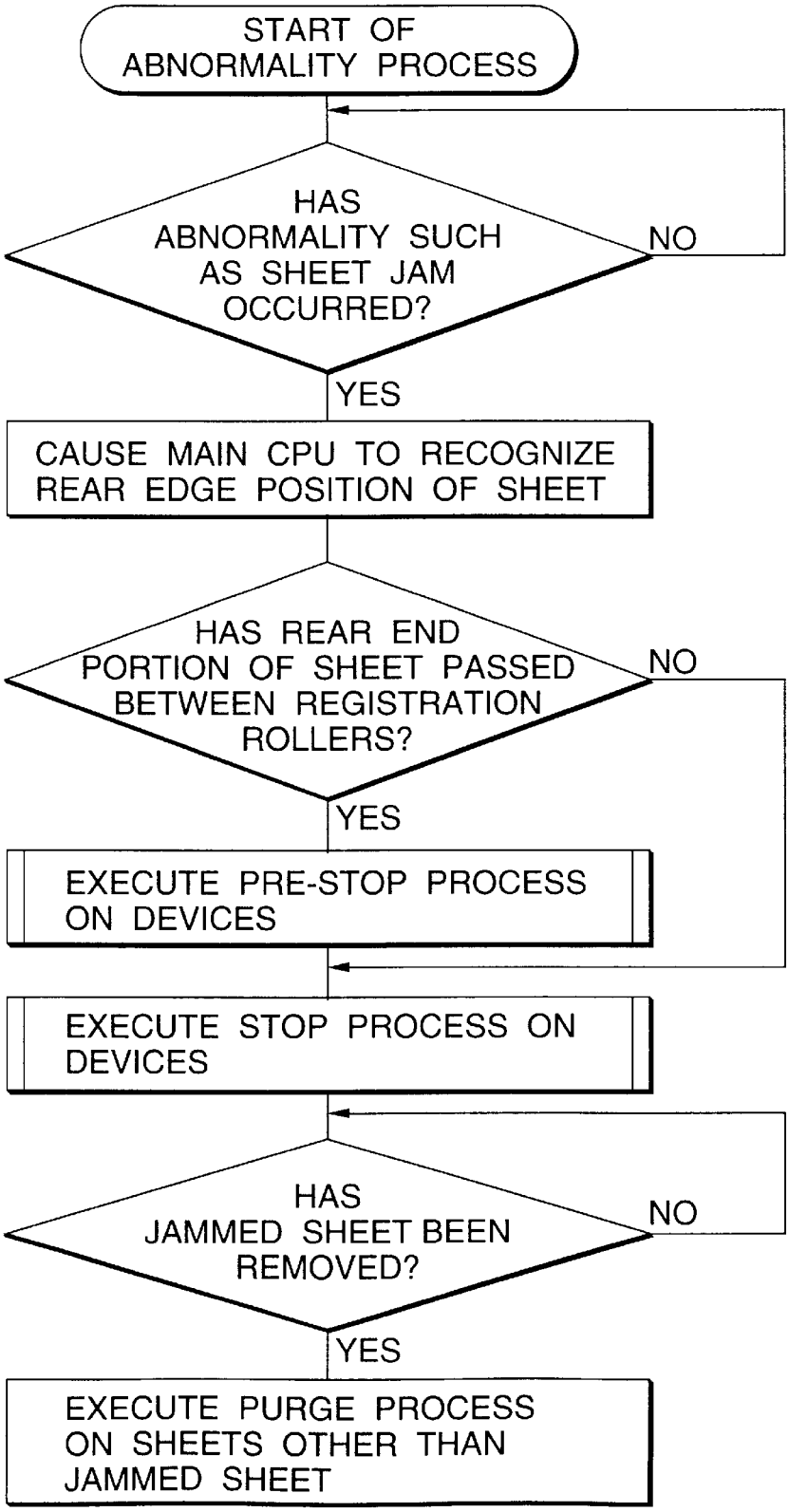
FIG. 4 is a flowchart showing a control process that is executed by the abnormality processing control system according to the first embodiment.

Now assume that a jam has occurred at a certain position in the apparatus. At this time, as shown in FIG. 4, the abnormality processing control device 75 recognizes the occurrence of the jam based on an abnormality detection signal (e.g., a jam detection signal) captured by itself, and also recognizes the rear edge position of a sheet P that is located in the vicinity of the second transfer position based on detection signals that are supplied from the respective position sensors 71 to 74.

If the rear end portion of the sheet P has passed between the registration rollers 52, the control device 75 executes a pre-stop process on devices and then performs a stop process on devices. On the other hand, if the rear end portion of the sheet P has not passed between the registration rollers 52, the control device 75 immediately performs a pre-stop process on the devices.

If a user thereafter removes the jammed sheet, the abnormality processing control device 75 executes a purge process on sheets other than the jammed sheet.

Incidentally, in this embodiment, since the bias roller 25 of the second transfer device 40 is softer than the backup roller 24, when loads are applied to the rollers 24 and 25 the bias roller 25 is elastically deformed and the front end portion of a sheet P starts to peel from the intermediate transfer belt 20.

For example, in a situation that the humidity inside the apparatus is 55% or less, the volume resistivity of the intermediate transfer belt 20 is 12.5 Log Ω·cm or more. After a portion of the intermediate transfer belt 20 has passed through the second transfer nip region, the surface potential of that portion becomes +2,000 V or more. On the other hand, after a sheet P has passed through the second transfer nip region, its potential becomes about −2,000 V because it is negatively charged when peeled from the intermediate transfer belt 20.

Figure 24A:
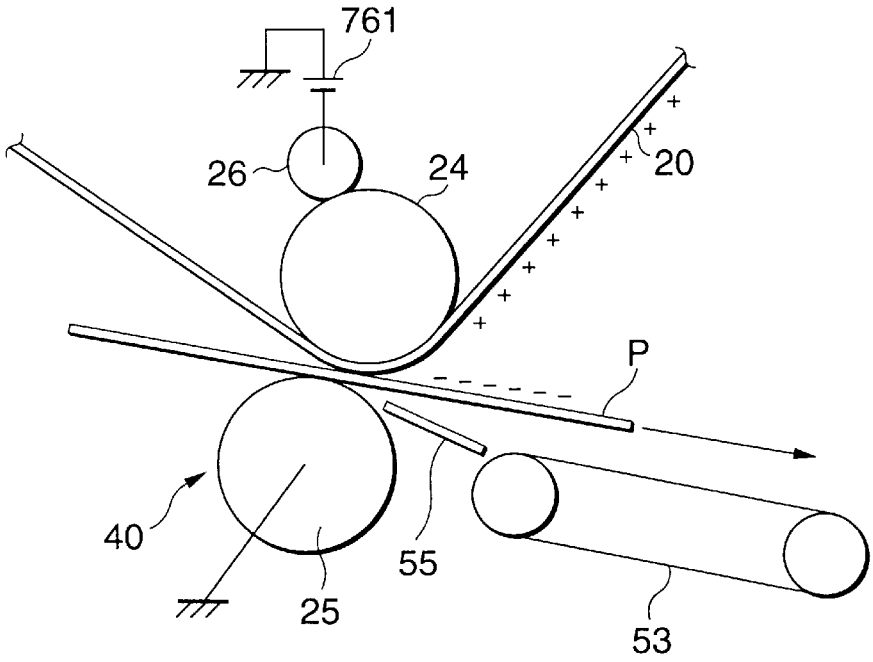
FIG. 24A shows a second transfer position and its vicinity in a comparative operation mode.
Figure 24B:
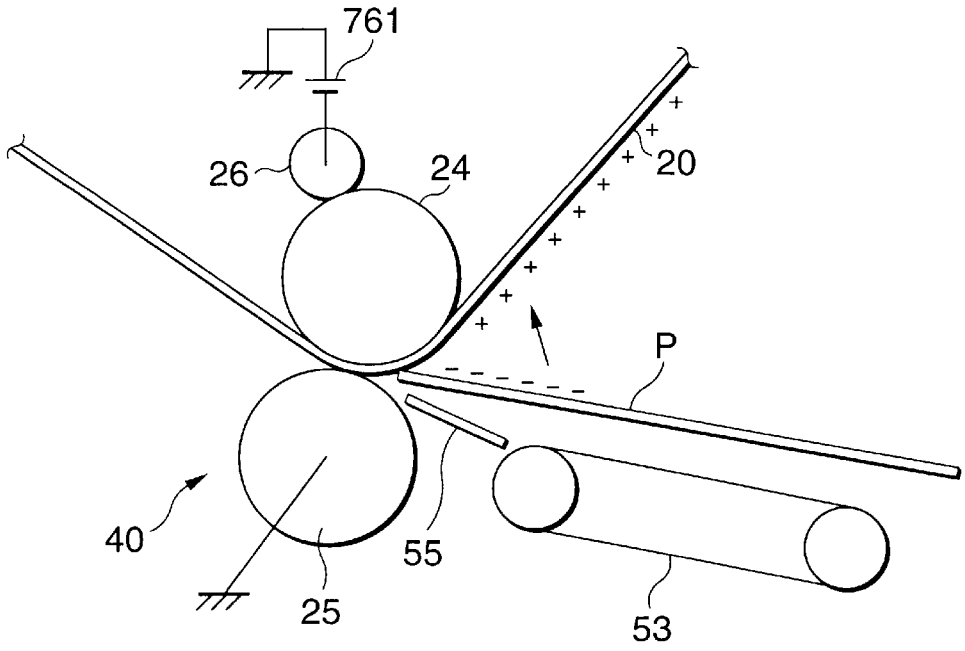
FIG. 24B shows a sheet sticking phenomenon that occurs at a region downstream of a second transfer position in the comparative operation mode at the occurrence of an abnormality such as a jam.

Therefore, in a comparative operation mode in which a pre-stop process like the one of this embodiment is not executed, there is fear that the rear end portion of the sheet P that is negatively charged is electrostatically absorbed on and stuck to the surface of the intermediate transfer belt 20 that is positively charged as shown in FIGS. 24A and 24B.

In contrast, in this embodiment, the following pre-stop process is performed on devices.

Figure 5:
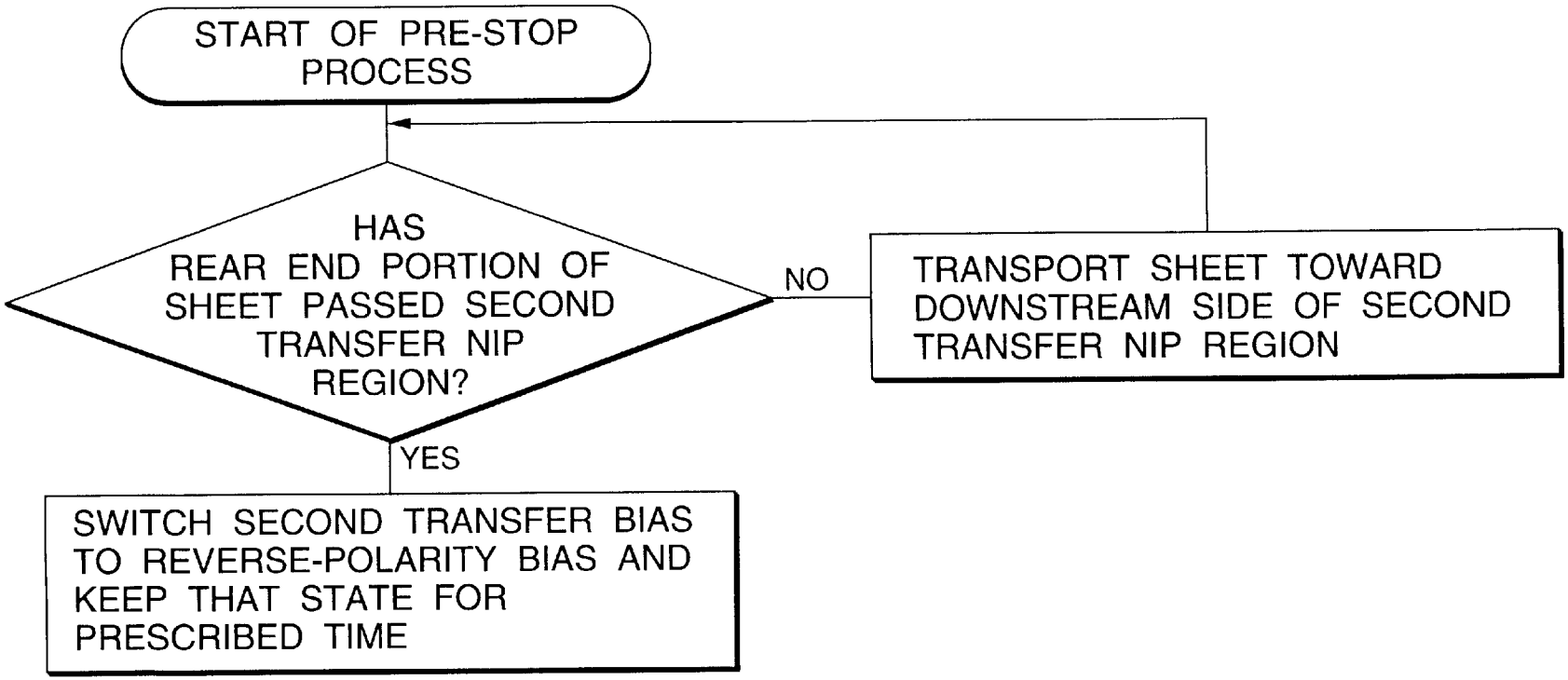
FIG. 5 is a flowchart showing a pre-stop process that is part of the control process of FIG. 4.
Figure 6:
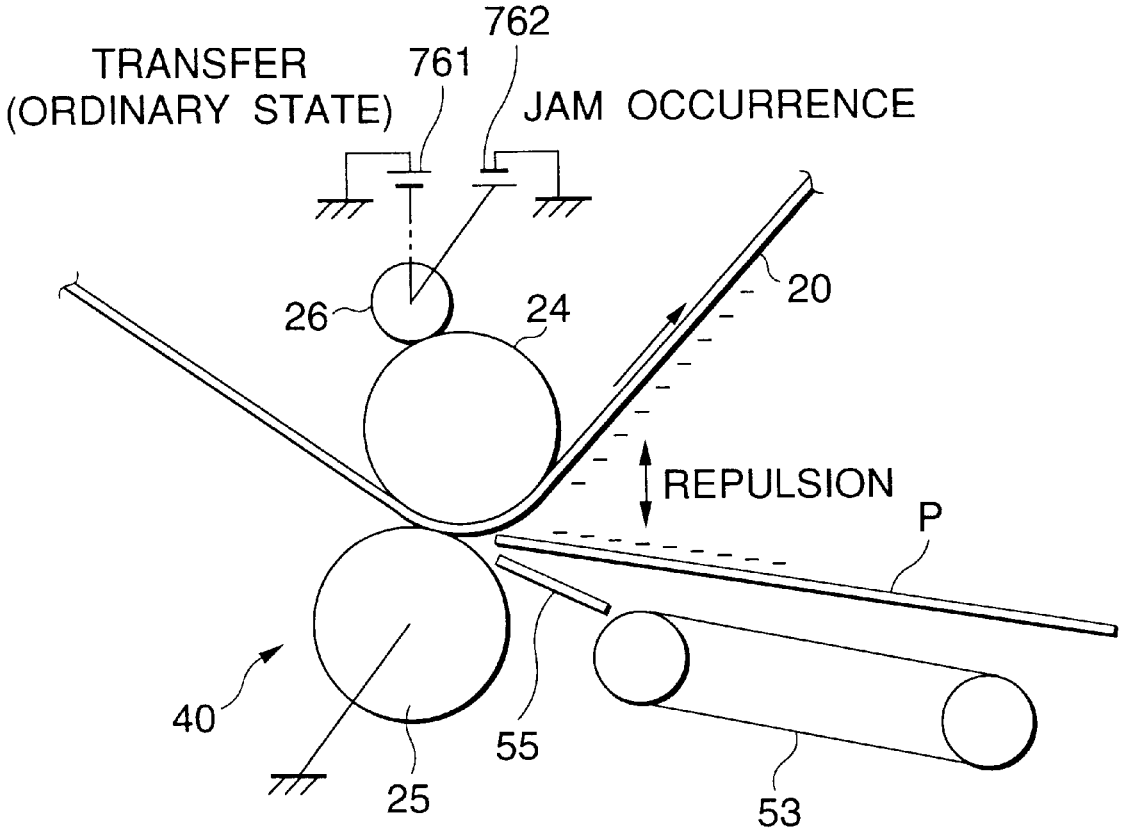
FIG. 6 schematically shows the pre-stop process according to the first embodiment.

FIG. 5 shows the pre-stop process according to this embodiment. It is judged whether the rear end portion of a sheet P has passed through the second transfer nip region. If the rear end portion of the sheet P has not passed through the second transfer nip region, the sheet P is transported downstream until its rear end portion passes through the second transfer nip region.

After the rear end portion of the sheet P has passed through the second transfer nip region, the second transfer bias is switched to the reverse-polarity bias (sticking prevention bias) and kept in that state for a prescribed time (e.g., 1 sec).

In this state, even under the above-mentioned environmental condition (e.g., the humidity inside the apparatus is 55% or less), even if the rear end portion of the sheet P that has passed through the second transfer nip region is left negatively charged, the rear end portion of the sheet P is effectively prevented from sticking to the intermediate transfer belt 20. This is because the surface of a portion of the intermediate transfer belt 20 that is located downstream of the second transfer nip region and opposed to the rear end portion of the sheet P is negatively charged because of the switching to the sticking prevention bias and hence the rear end portion of the sheet P and the intermediate transfer belt 20 repel each other in the region downstream of the second transfer nip region.

Modification 1

Figure 7:
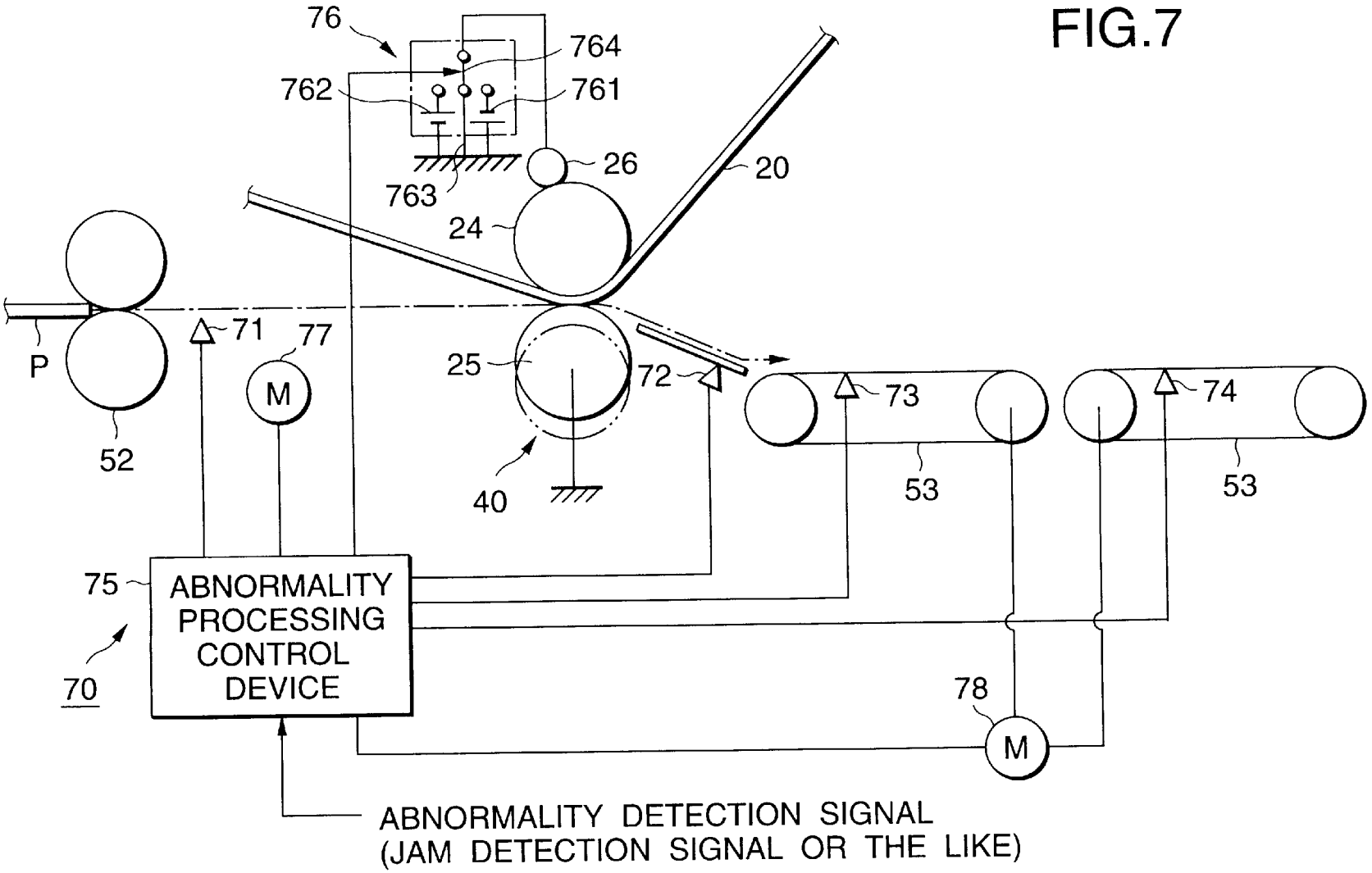
FIG. 7 shows an abnormality processing control system according to a first modification.

In the abnormality processing control system 70 according to the first embodiment, the nipping state of the second transfer roller 25 at the occurrence of an abnormality such as a jam is kept as it is. However, the invention is not limited to such a case. For example, as in the first modification that is illustrated in FIGS. 7 and 8, the nipping state of the second transfer roller 25 may be canceled.

Figure 8:
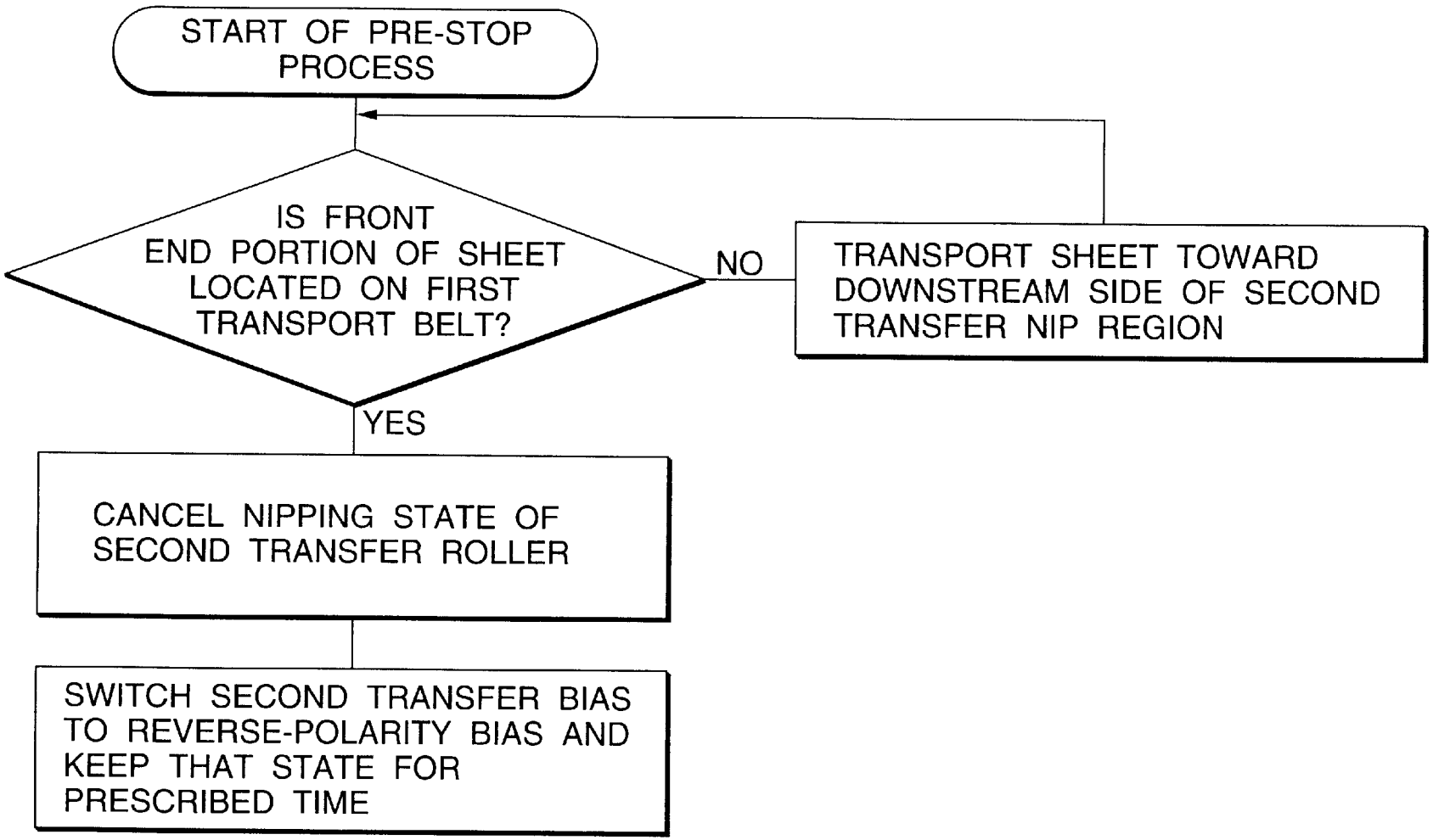
FIG. 8 is a flowchart showing a pre-stop process according to the first modification.

In a pre-stop process according to the first modification, as shown in FIG. 8, the nipping state is canceled and the second transfer bias is switched to the reverse-polarity bias at a time point when the front end portion of a sheet P reaches the first transport belt 53 as a result of transporting the sheet P downstream until its front end portion reaches the first transport belt 53 (specifically, at a time point when it becomes possible for the transport belts 53 to transport the sheet P). This state is kept for a prescribed time.

Figure 9:
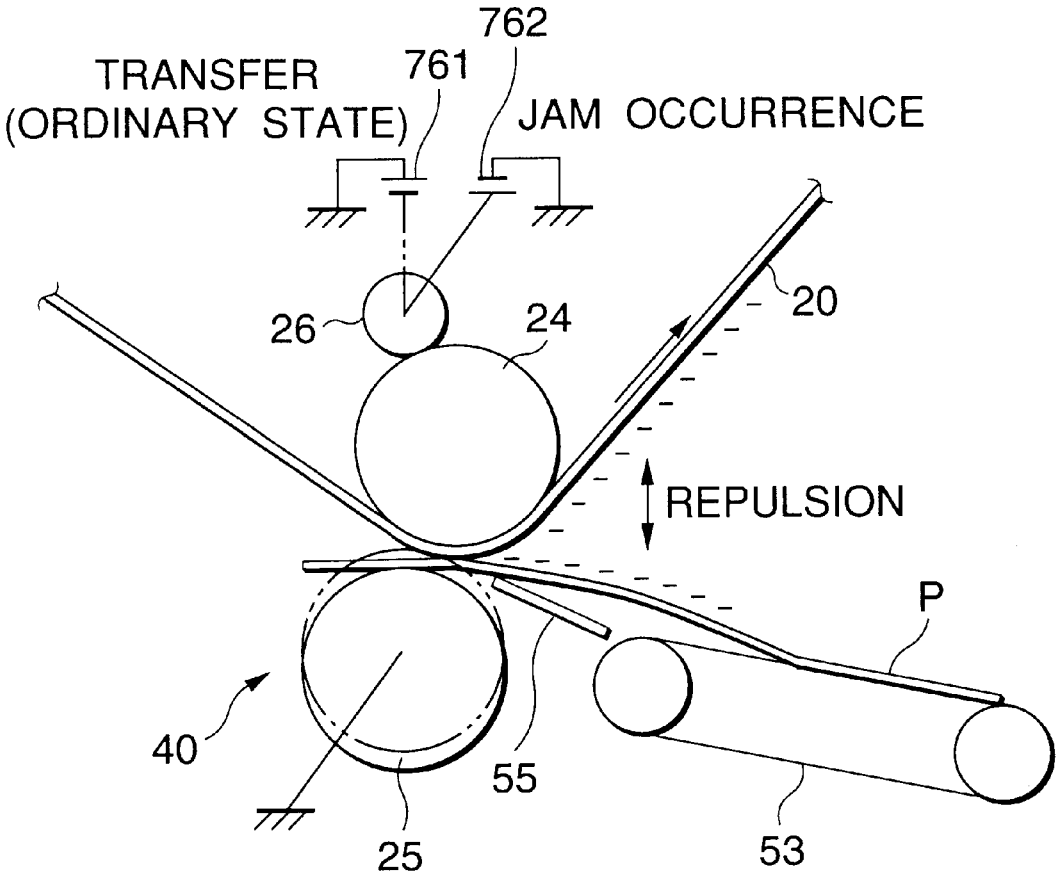
FIG. 9 schematically shows the pre-stop process according to the first modification.

As shown in FIG. 9, although immediately before the nipping state of the second transfer roller 25 is canceled a portion of the sheet P that has passed through the second transfer nip region is negatively charged, the rear end portion of the sheet P is effectively prevented from sticking to the intermediate transfer belt 20. This is because the surface of a portion of the intermediate transfer belt 20 that is located downstream of the second transfer nip region and opposed to the rear end portion of the sheet P is negatively charged because of the switching to the sticking prevention bias and hence the rear end portion of the sheet P and the intermediate transfer belt 20 repel each other in the region downstream of the second transfer nip region.

Modification 2

Figure 10:
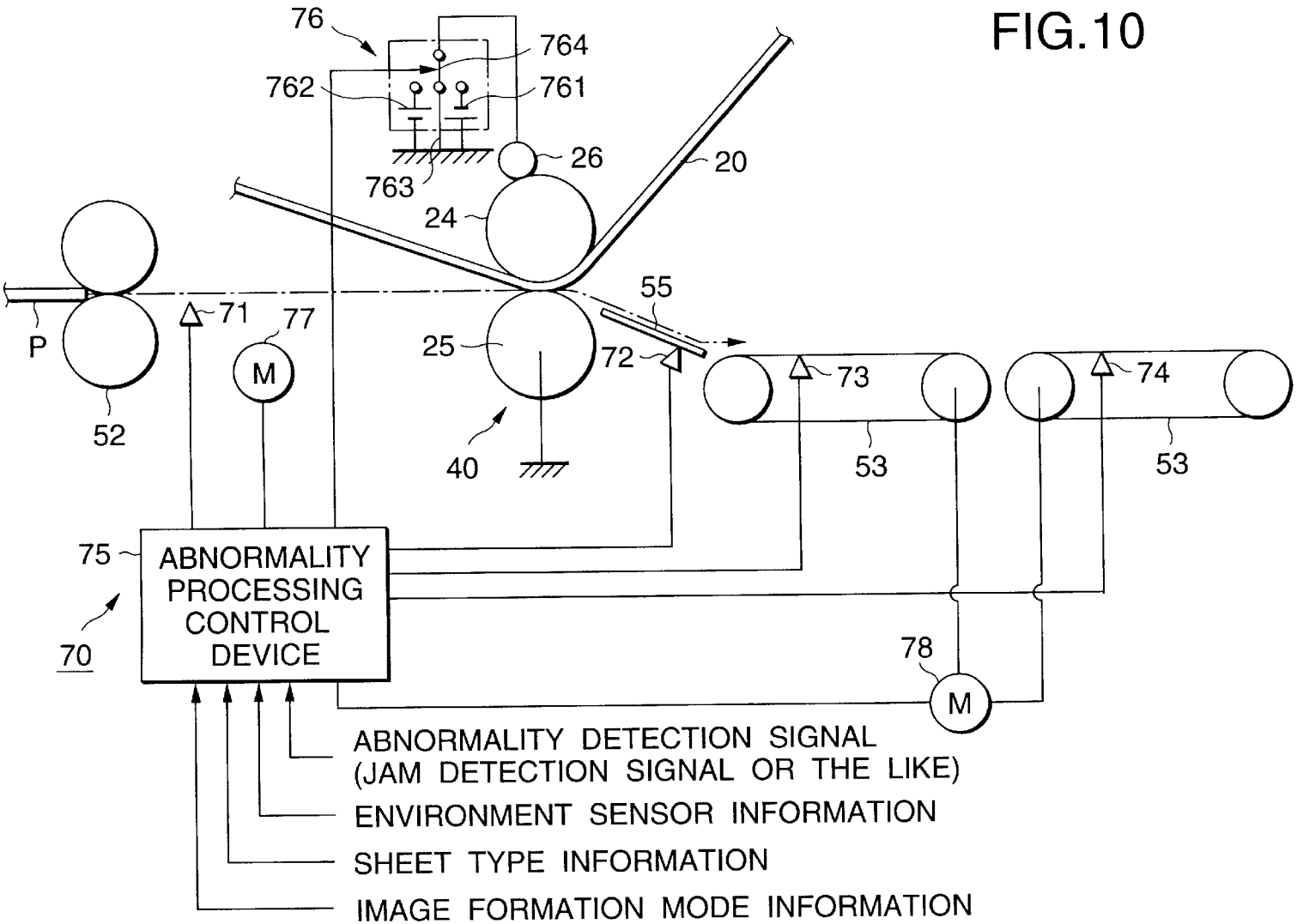
FIG. 10 shows an abnormality processing control system according to a second modification.
Figure 11:
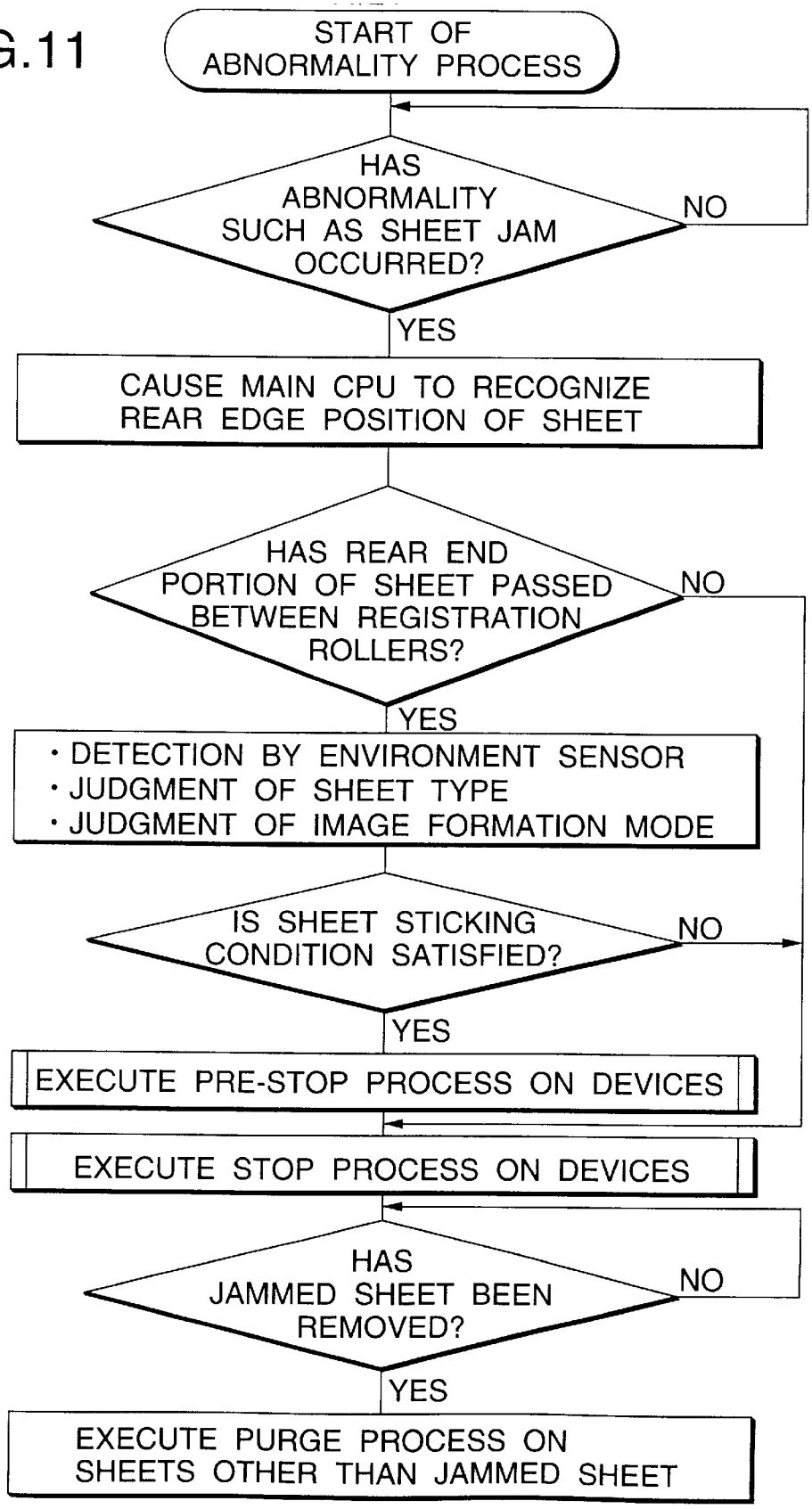
FIG. 11 is a flowchart showing a pre-stop process according to the second modification.

In the abnormality processing control system 70 according to the first embodiment, if a sheet P exists downstream of and in the vicinity of the second transfer nip region at the occurrence of an abnormality such as a jam, a pre-stop process is always executed on devices. However, the invention is not limited to such a case. For example, as in a second modification that is illustrated in FIGS. 10 and 11, even if a sheet P exists downstream of and in the vicinity of the second transfer nip region at the occurrence of an abnormality such as a jam, a pre-stop process may be executed selectively in accordance with the use conditions of the sheet P.

In the second modification, to define a condition under which a sheet P is prone to stick to the intermediate transfer belt 20 (i.e., a sheet sticking condition), the environment (humidity), the sheet type, and the image formation mode are selected as parameters.

For example, a sheet sticking condition is such that the type of sheet used is plain paper and the humidity that is detected by the environment sensor 44 provided inside the machine is lower than W % (in this example, 55%) or the image formation mode is a double-sided recording mode and the copying surfaces are duplex surfaces (both surfaces) under conditions that the type of sheet used is plain paper and the environment humidity is W % or more.

That is, the abnormality process according to the second modification is basically the same as that according to the first embodiment and different from the latter in the following. As shown in FIG. 11, a step of judging whether to execute a pre-step process on devices is added. In this step, whether the above-described sheet sticking condition is satisfied is checked after the detection by the environment sensor 44 and the judgments of the sheet type and the image formation mode. A pre-stop process is executed on the devices only when the sheet sticking condition is satisfied.

It is noted that the first and second modifications that are applied to the first embodiment in the above description can also be applied to second to sixth embodiments described below.

Embodiment 2

Figure 12:
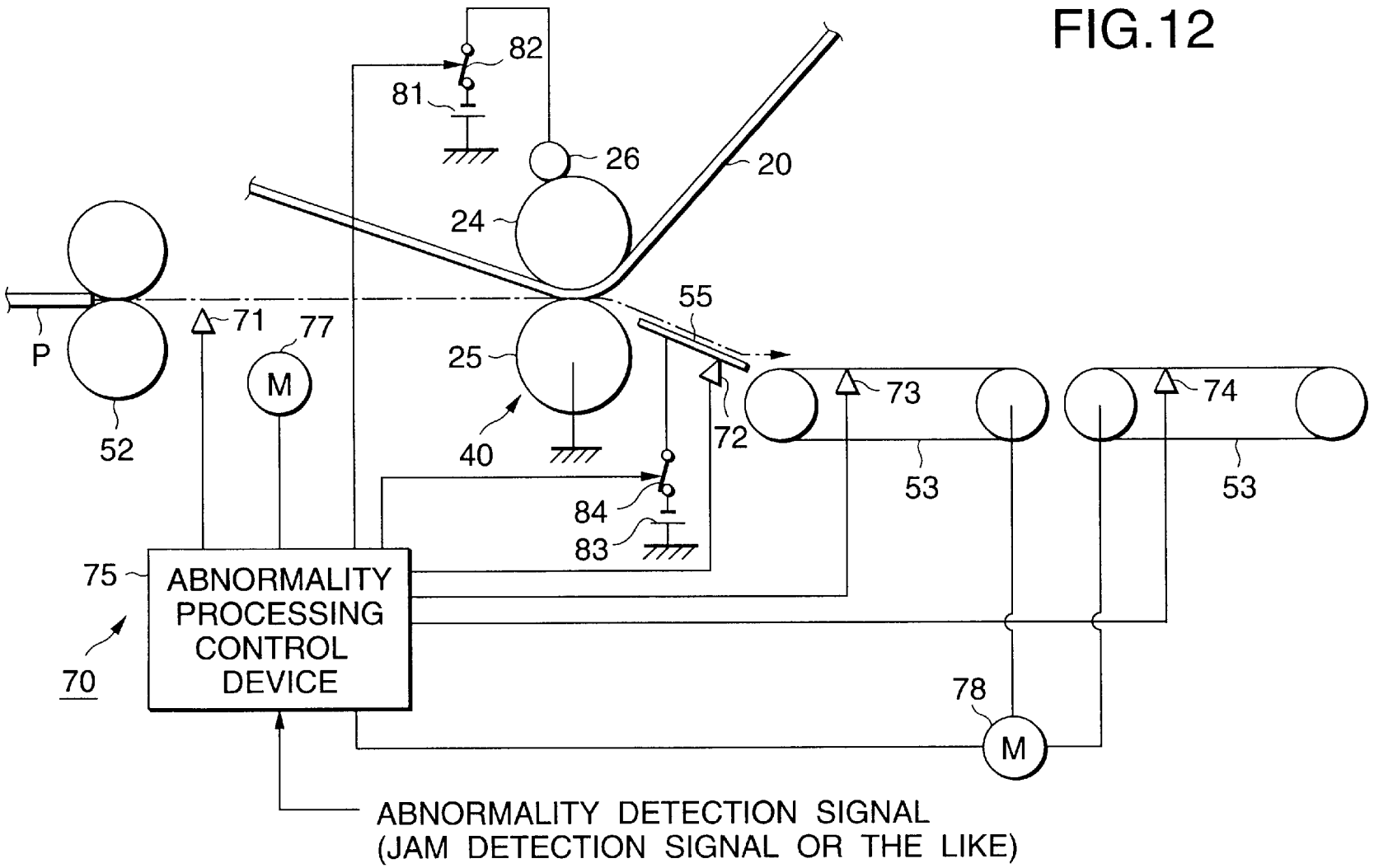
FIG. 12 shows an abnormality processing control system according to a second embodiment of the invention.

FIG. 12 shows an abnormality processing control system according to a second embodiment of the invention.

The abnormality processing control system 70 according to this embodiment is generally the same as that according to the first embodiment and different from the latter in the following. A transfer bias voltage source 81 for applying a second transfer bias (in this example, a bias having the same polarity (negative polarity) as the toner charging polarity) is connected, via a switch 82, to the electricity feed roller 26. On the other hand, an adsorption bias voltage source 83 for applying an adsorption bias (in this example, a bias having the same polarity (negative polarity) as the toner charging polarity) is connected, via a switch 84, to the exit chute 55 that is disposed downstream of and in the vicinity of the second transfer nip region. The components of this embodiment that are the same as the corresponding components in the first embodiment are given the same reference numerals as the latter and detailed descriptions for those components are omitted.

In this embodiment, although the abnormality process is executed generally in the same manner as in the first embodiment, the pre-stop process on devices is different than in the first embodiment.

Figure 13:
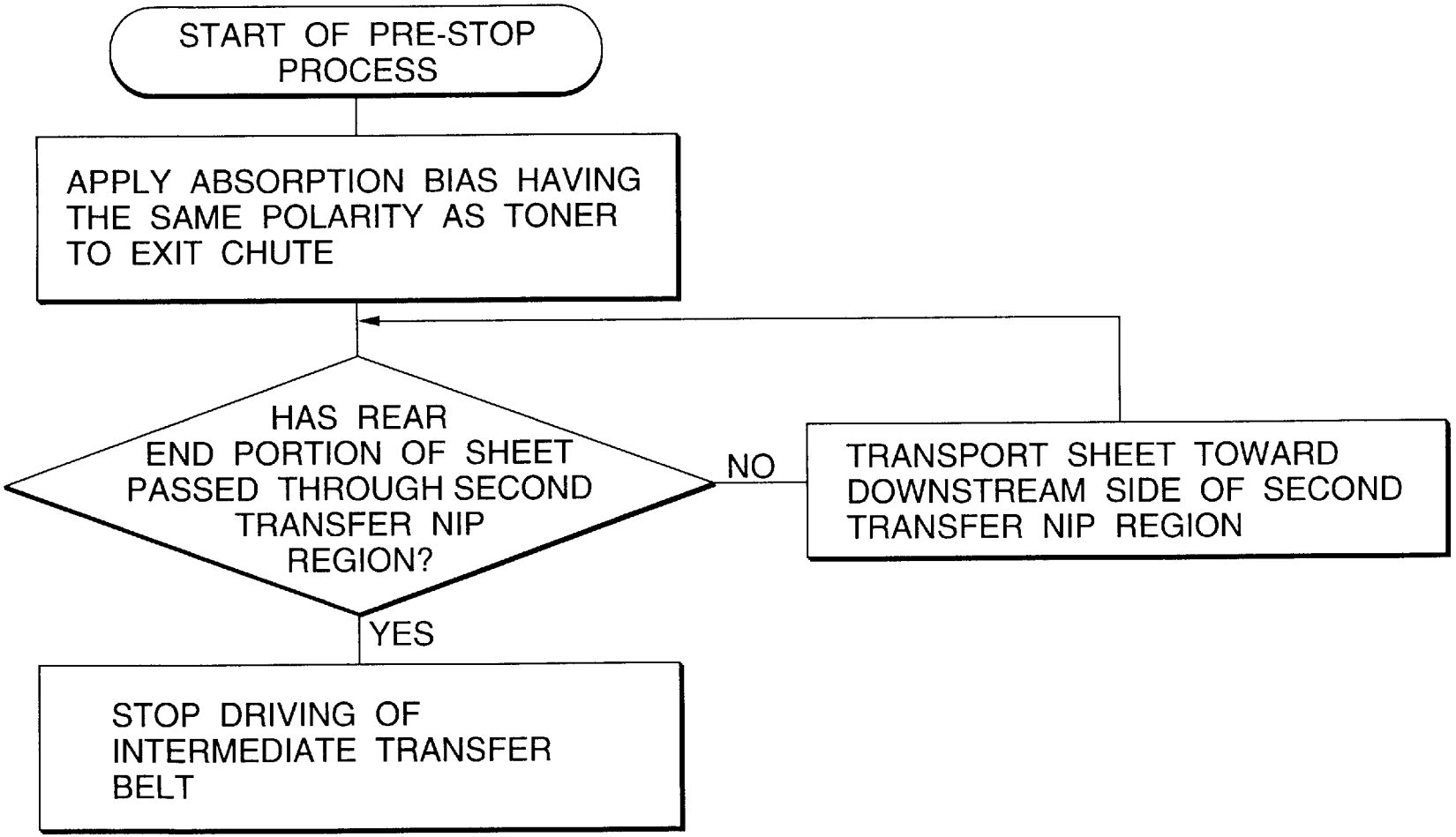
FIG. 13 is a flowchart showing a pre-stop process according to the second embodiment.

In the pre-stop process according to this embodiment, as shown in FIG. 13, the adsorption bias (e.g., −2 to −3 kV) having the same polarity as the toner is applied to the exit chute 55. A sheet P is transported downstream until the rear end portion of the sheet P passes through the second transfer nip region. The driving of the intermediate transfer belt 20 is stopped at a time point when the rear end portion of the sheet P has passed through the second transfer nip region.

Figure 14:
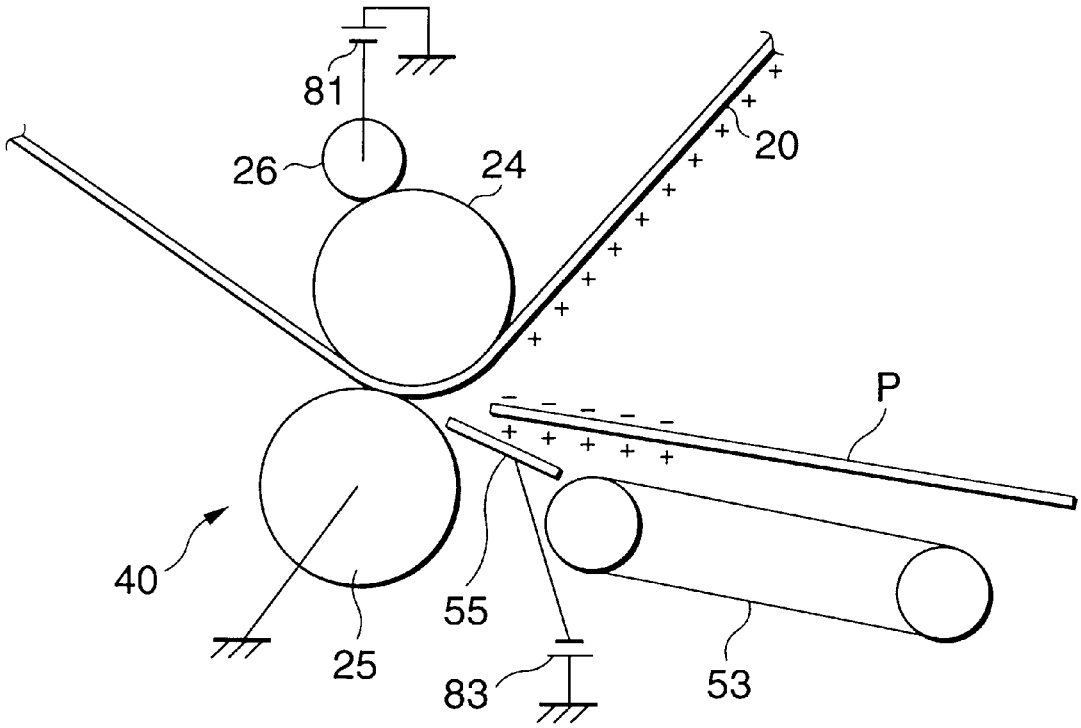
FIG. 14 schematically shows the pre-stop process according to the second embodiment.

Therefore, in this embodiment, as shown in FIG. 14, the rear end of a sheet P that has passed through the second transfer nip region is left negatively charged and the surface of a portion of the intermediate transfer belt 20 that is opposed to the rear end of the sheet P and located downstream of the second transfer nip region is positively charged. However, since the adsorption bias (in this embodiment, a negative bias) is applied to the exit chute 55, positive charges are induced on the back surface of the rear end portion of the exit chute 55 and the rear end portion of the sheet P is electrostatically absorbed on the exit chute 55 that is closer to the rear end portion of the sheet P than the intermediate transfer belt 20 is. Therefore, the rear end portion of the sheet P is effectively prevented from sticking to the intermediate transfer belt 20.

In this embodiment, since the adsorption bias that is applied to the exit chute 55 has the same polarity as the toner, positive charges are induced on the back surface of the rear end portion of the sheet P. However, the toner on the front surface of the rear end portion of the sheet P is electrostatically attracted by those positive charges and held on the sheet P. The possibility of scattering of toner images are reduced so much more.

Modification 3

Figure 15:
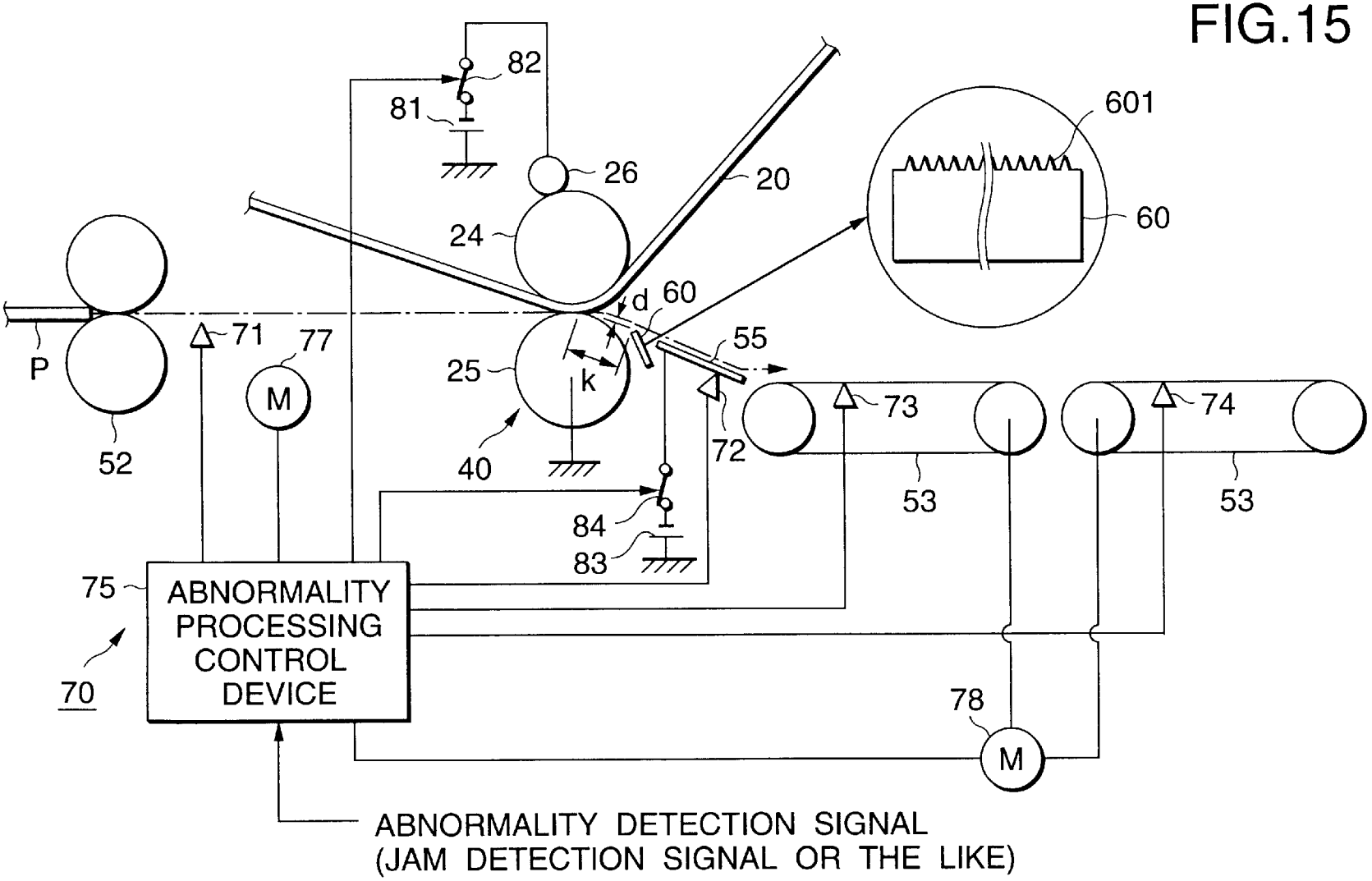
FIG. 15 shows an abnormality processing control system according to a third modification.

In the second embodiment, the adsorption bias is applied to the exit chute 55. However, the invention is not limited to such a case. For example, as shown in FIG. 15, the adsorption bias may be applied to a peeling electrode plate 60 that is disposed between the second transfer nip region and the exit chute 55 (e.g., by using an adsorption bias voltage source 83 and a switch 84).

The peeling electrode plate 60 is formed by using a stainless steel plate of, for example, about 0.5 mm in thickness. To concentrate an electric field acting on a sheet P, a number of needle-like protrusions 601 are arranged on the surface of the peeling electrode plate 60 on the sheet P side.

The peeling electrode plate 60 is disposed in such a manner that its side end portion on the nip region side is deviated by d (in this example, 1 mm) from a reference line that is perpendicular to the straight line connecting the central axes of the bias roller 25 and the backup roller 24 and passes through the exit of the nip region of the bias roller 25 and the backup roller 24, and that the side end portion of the peeling electrode plate 60 is distant from the exit of the nip region by a small gap k (in this example, 7 mm).

Embodiment 3

Figure 16:
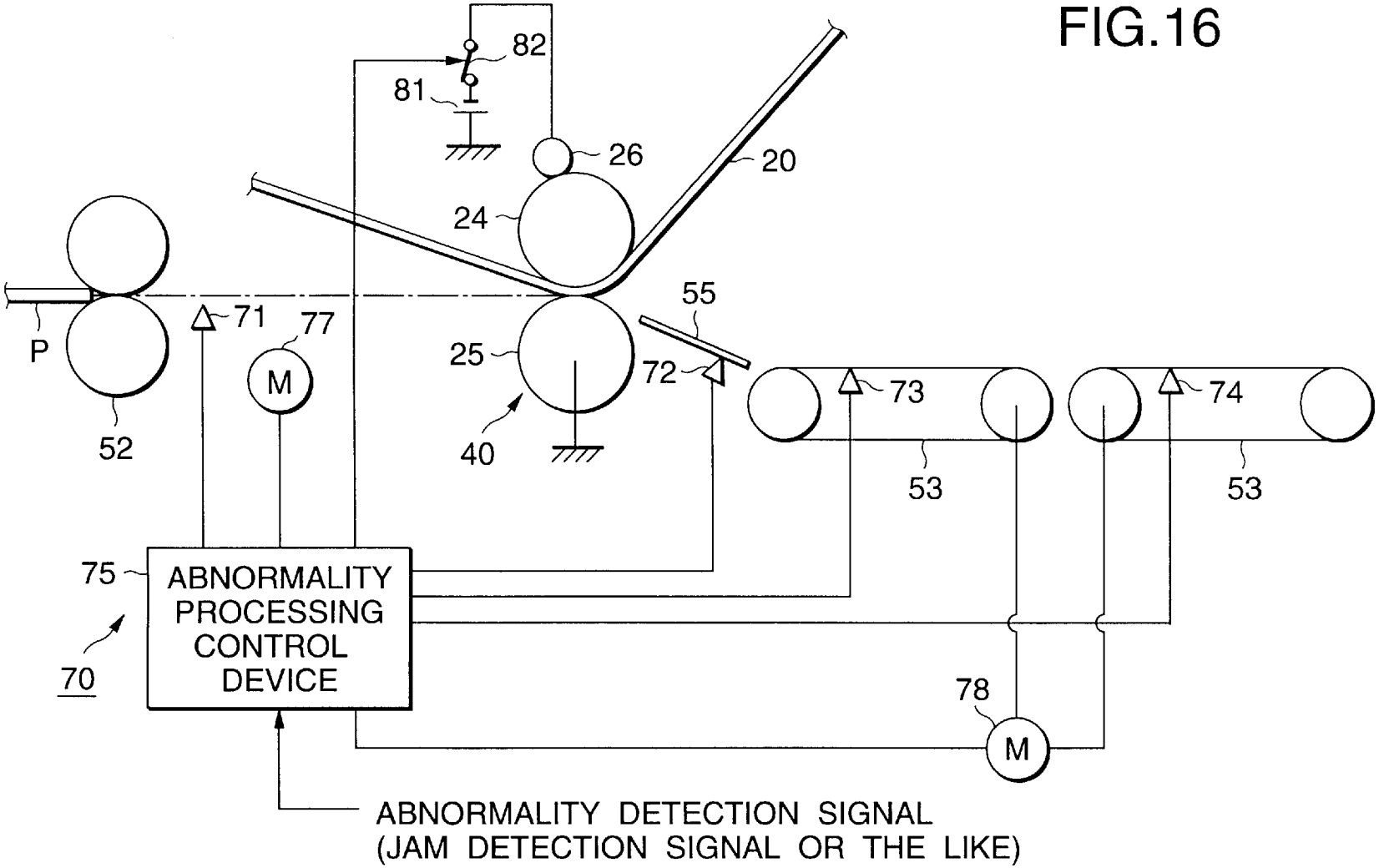
FIG. 16 shows an abnormality processing control system according to the third embodiment of the invention.

FIG. 16 shows an abnormality processing control system according to a third embodiment of the invention.

The abnormality processing control system 70 according to this embodiment is generally the same as that according to the second embodiment and different from the latter in the following. Although a transfer bias voltage source 81 for applying a second transfer bias (in this example, a bias having the same polarity (negative polarity) as the toner charging polarity) is connected to the electricity feed roller 26 via a switch 82, the exit chute 55 that is disposed downstream of and in the vicinity of the second transfer nip region is merely grounded. The components of this embodiment that are the same as the corresponding components in the second embodiment are given the same reference numerals and detailed descriptions for those components are omitted.

In this embodiment, although the abnormality process is executed generally in the same manner as in the second embodiment, the pre-stop process on devices is different than in the second embodiment.

Figure 17:
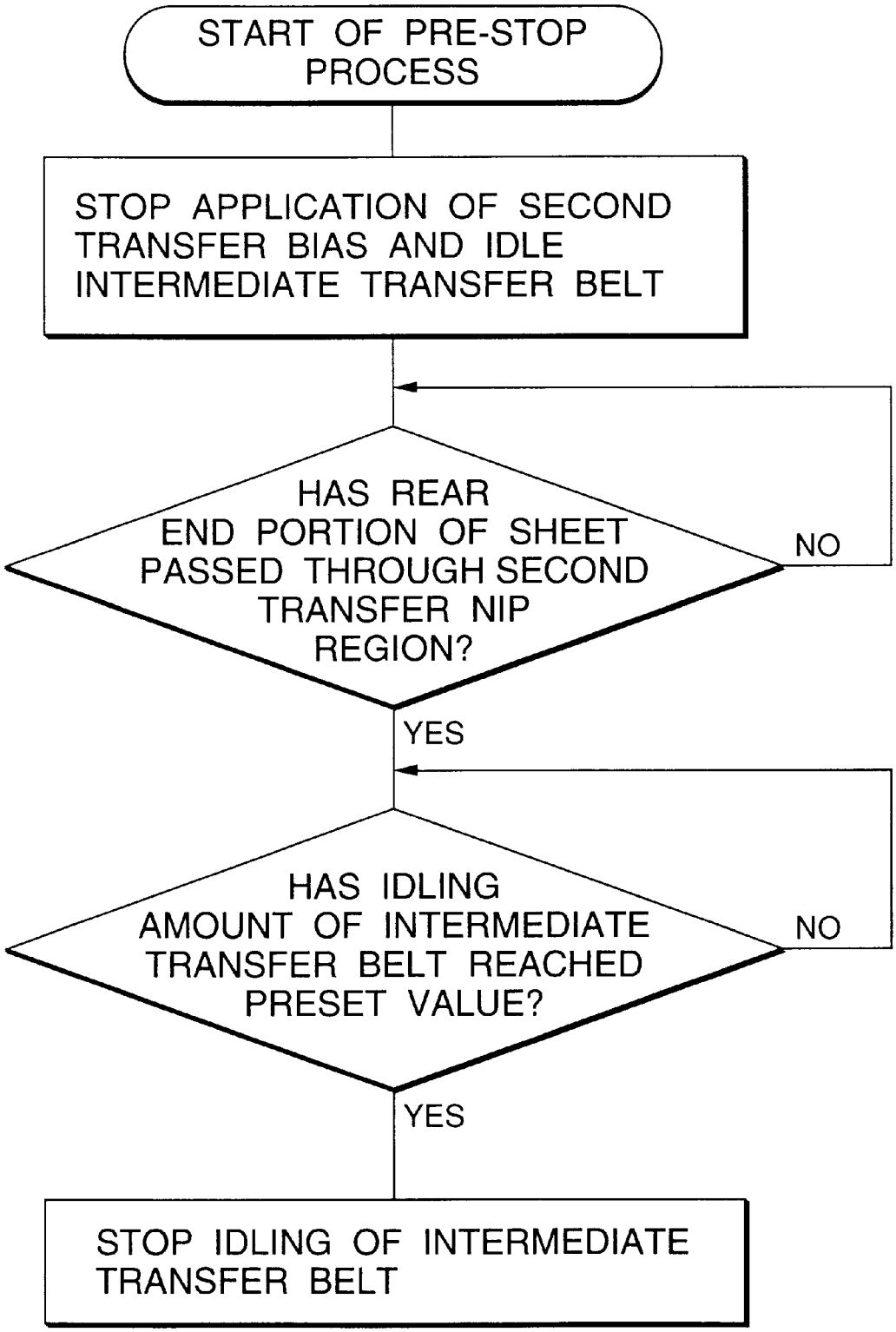
FIG. 17 is a flowchart showing a pre-stop process according to the third embodiment.

In the pre-stop process according to this embodiment, as shown in FIG. 17, the application of the second transfer bias is stopped and the intermediate transfer belt 20 is idled. The idling of the intermediate transfer belt 20 is stopped on condition that the rear end portion of a sheet P has passed through the second transfer nip region and the amount of idling of the intermediate transfer belt 20 has reached a preset value (e.g., 1 second has elapsed after the rear end portion of the sheet P has passed through the second transfer nip region).

Figure 18:
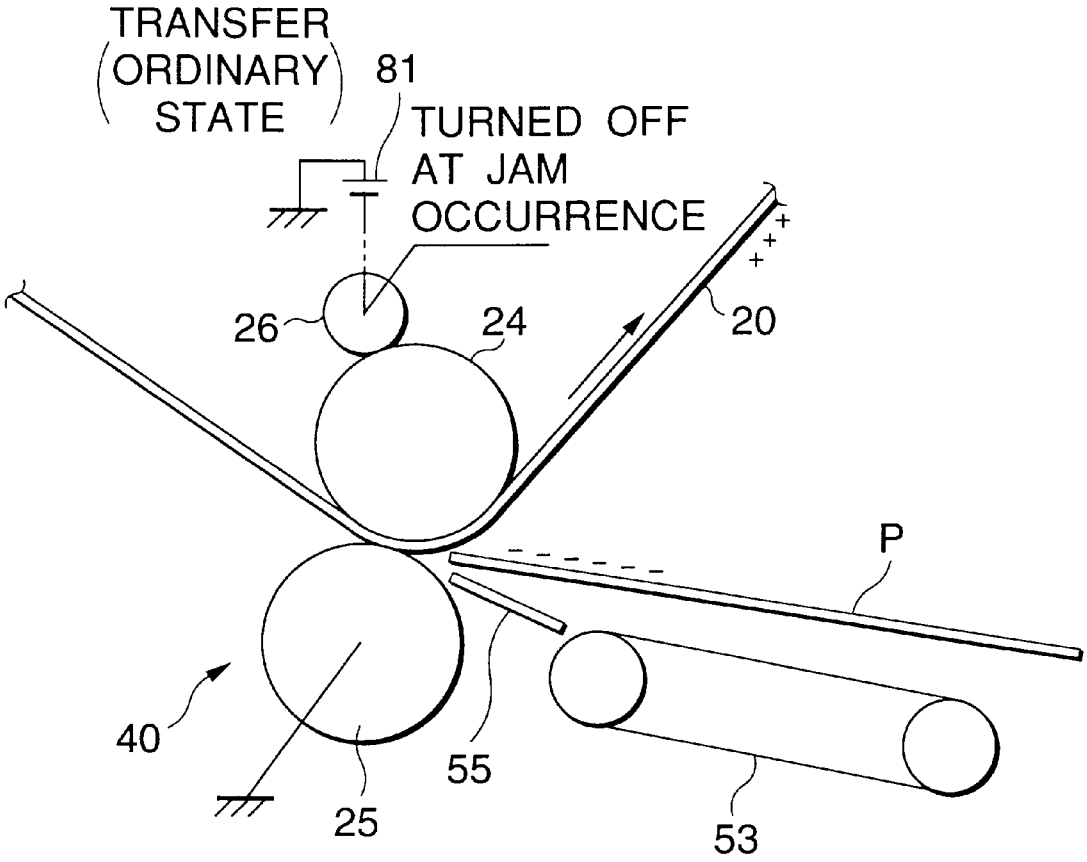
FIG. 18 schematically shows the pre-stop process according to the third embodiment.

Therefore, in this embodiment, as shown in FIG. 18, in a situation that a sheet P has passed through the second transfer nip region before the second transfer bias is turned off, the rear end portion of the sheet P that has passed through the second transfer nip region is left negatively charged. However, since the second transfer bias is turned off, the surface of a portion of the intermediate transfer belt 20 that is located downstream of the second transfer nip region and opposed to the rear end portion of the sheet P is rendered in a non-charged state. Therefore, electrostatic attractive force is hard to act between the rear end portion of the sheet P and the intermediate transfer belt 20 in the region downstream of the second transfer nip region, and hence the rear end portion of the sheet P is effectively prevented from sticking to the intermediate transfer belt 20.

Embodiment 4

An abnormality processing control system according to this embodiment is generally configured in the same manner as the abnormality processing control system according to the third embodiment. An abnormality process according to this embodiment is executed generally in the same manner as in the third embodiment and different than in the third embodiment in that a pre-stop process is executed on a different set of devices than in the third embodiment.

Figure 19:
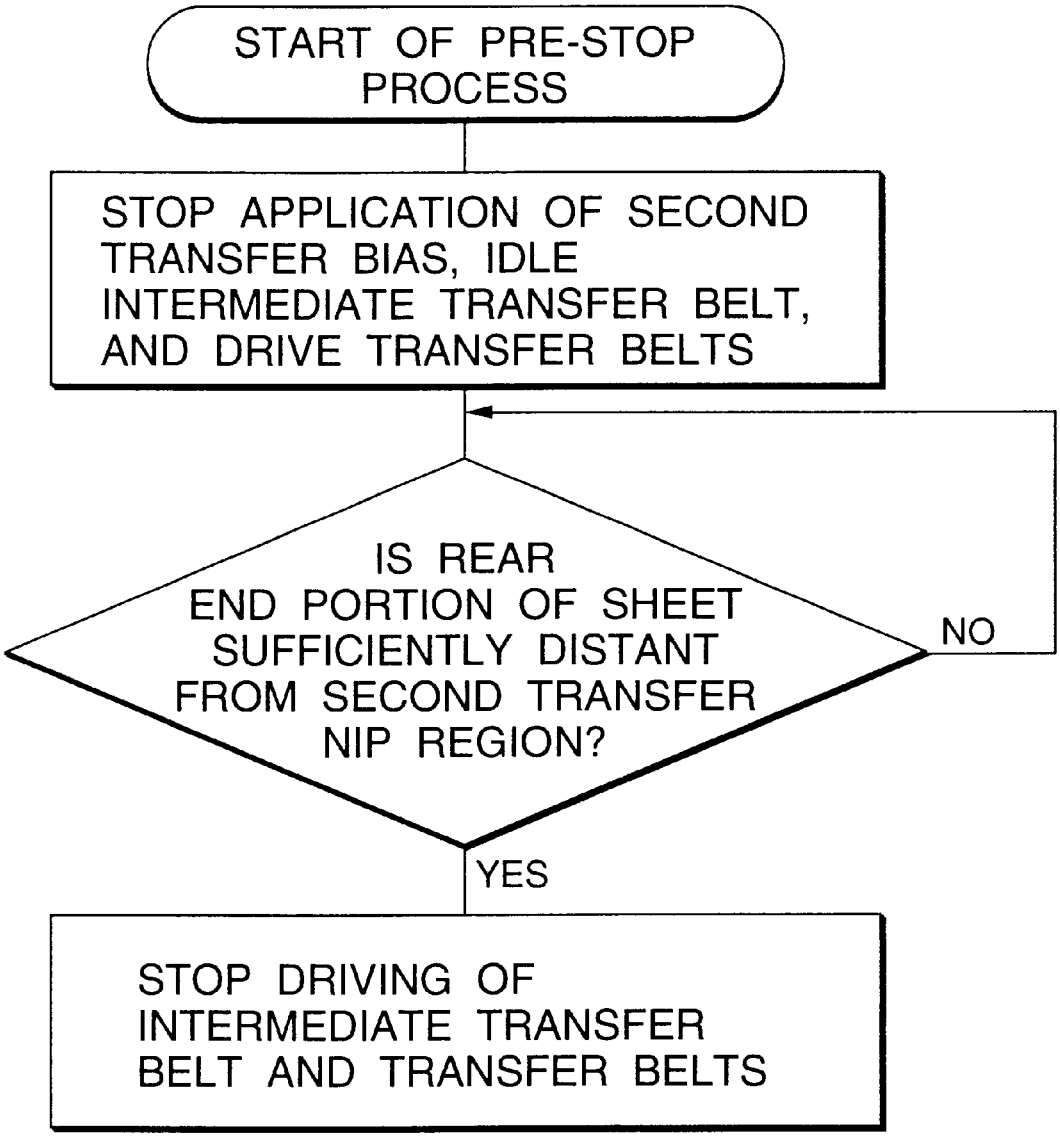
FIG. 19 shows an abnormality processing control system according to a fourth embodiment of the invention.

That is, in the pre-stop process according to this embodiment, as shown in FIG. 19, the application of the second transfer bias is stopped, the intermediate transfer belt 20 is idled, and the transport belts 53 are driven. The driving of the intermediate transfer belt 20 and the transport belts 53 is stopped on condition that the rear end portion of a sheet P is sufficiently distant from the second transfer nip region.

The condition that the rear end portion of a sheet P is sufficiently distant from the second transfer nip region means that the rear end portion of the sheet P is not electrostatically attracted by the intermediate transfer belt 20 even if the rear end portion of the sheet P is negatively charged, for example.

Figure 20:
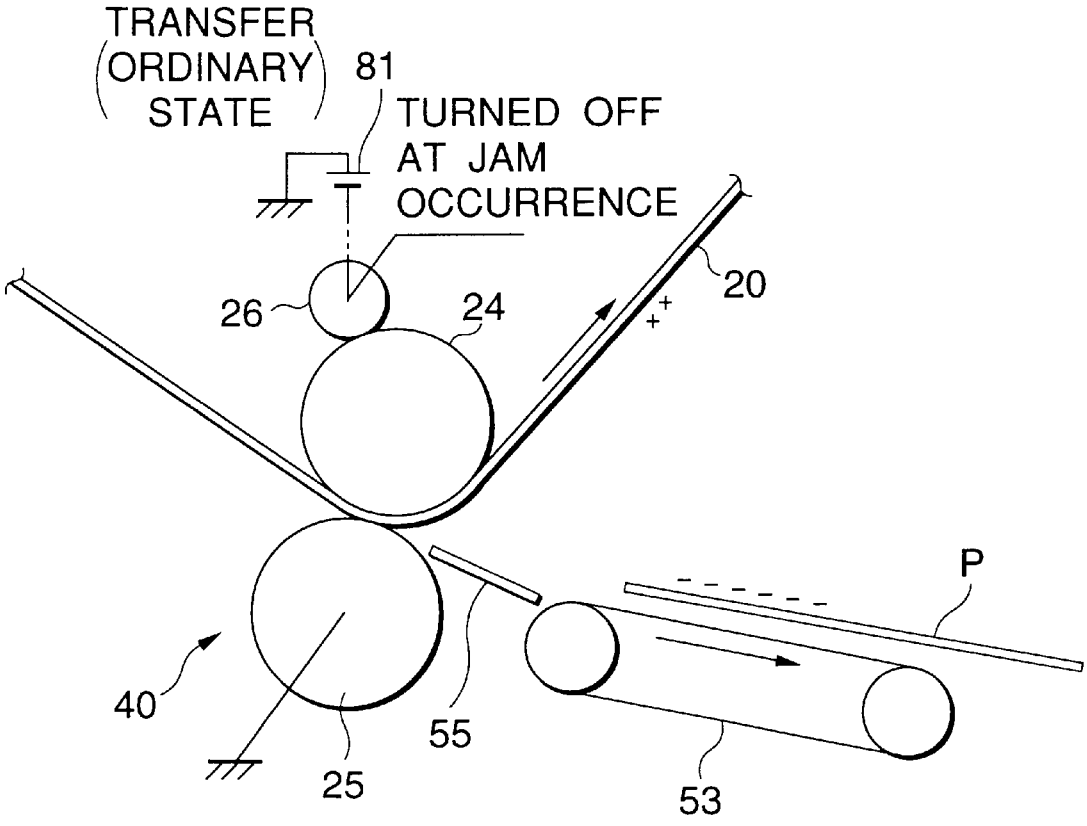
FIG. 20 is a flowchart showing a pre-stop process according to the fourth embodiment.

Therefore, in this embodiment, as shown in FIG. 20, in a situation that a sheet P has passed through the second transfer nip region before the second transfer bias is turned off, the rear end portion of the sheet P that has passed through the second transfer nip region may be left negatively charged. However, since the sheet P itself has been transported to a position that is sufficiently distant from the second transfer nip region and a charged portion of the intermediate transfer belt 20 that is located downstream of the second transfer nip region is gradually separated from the second transfer nip region, almost no electrostatic attractive force act between the rear end portion of the sheet P and the intermediate transfer belt 20 in the region downstream of the second transfer nip region. Therefore, the rear end portion of the sheet P is reliably prevented from sticking to the intermediate transfer belt 20.

Although in this embodiment the driving of the intermediate transfer belt 20 and that of the transport belts 53 are stopped at the same time, the driving of the intermediate transfer belt 20 may be stopped before the driving of the transport belts 53 is stopped, at a time point when the rear end portion of the sheet P has passed through the second transfer nip region.

Embodiment 5

Figure 21:
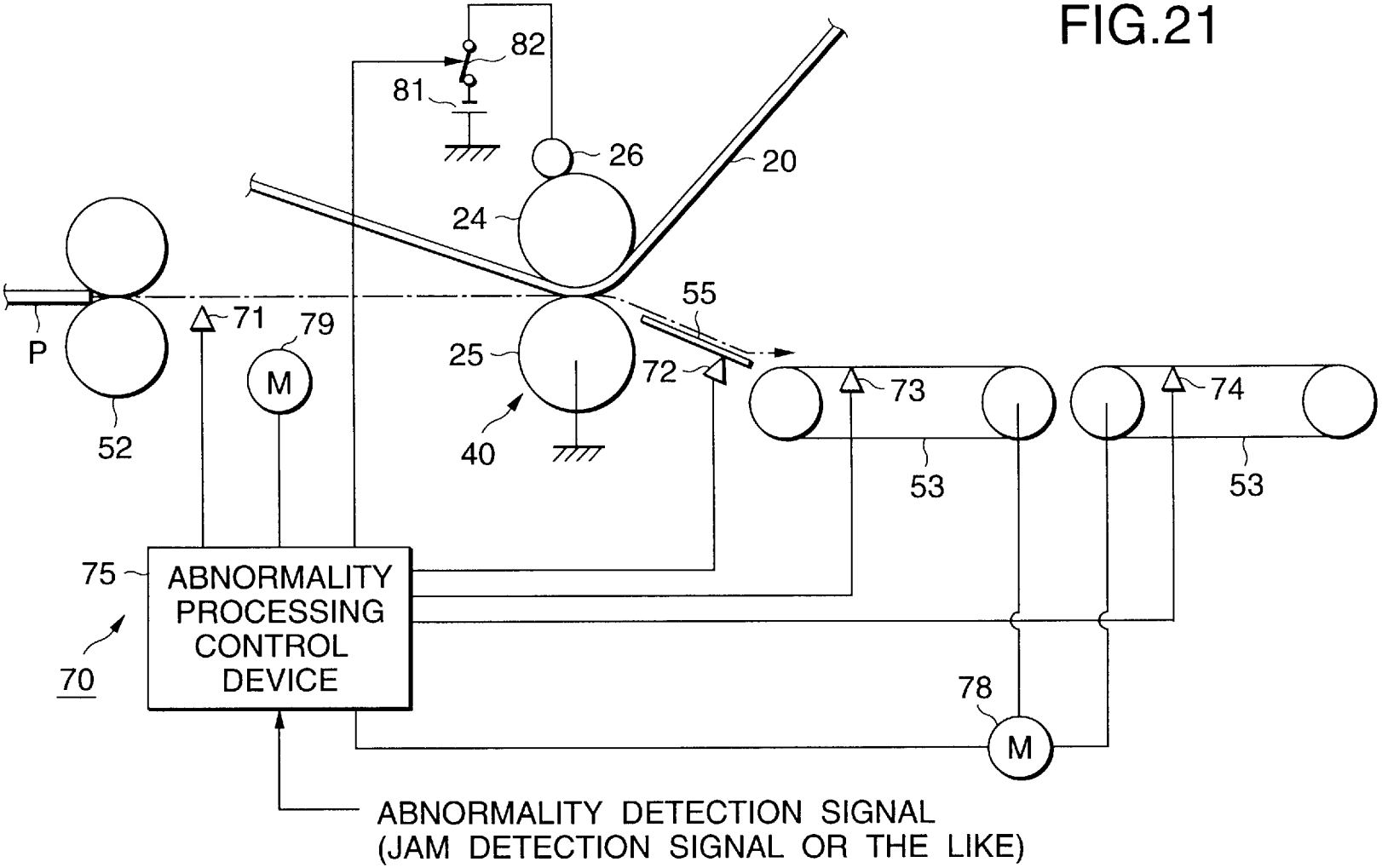
FIG. 21 shows an abnormality processing control system according to a fifth embodiment of the invention.

FIG. 21 shows an abnormality processing control system according to a fifth embodiment of the invention.

The abnormality processing control system 70 according to this embodiment is generally the same as that according to the third embodiment and different from the latter in that a drive motor 79 capable of rotating in both normal and reverse directions is used as a drive source for the drive roller 21 for the intermediate transfer belt 20. The components of this embodiment that are the same as the corresponding components of the third embodiment are given the same reference numerals as the latter and detailed descriptions therefor are omitted.

An abnormality process according to this embodiment is executed generally in the same manner as in the third embodiment and different than in the third embodiment in that a pre-stop process is executed on a different set of devices than in the third embodiment.

Figure 22:
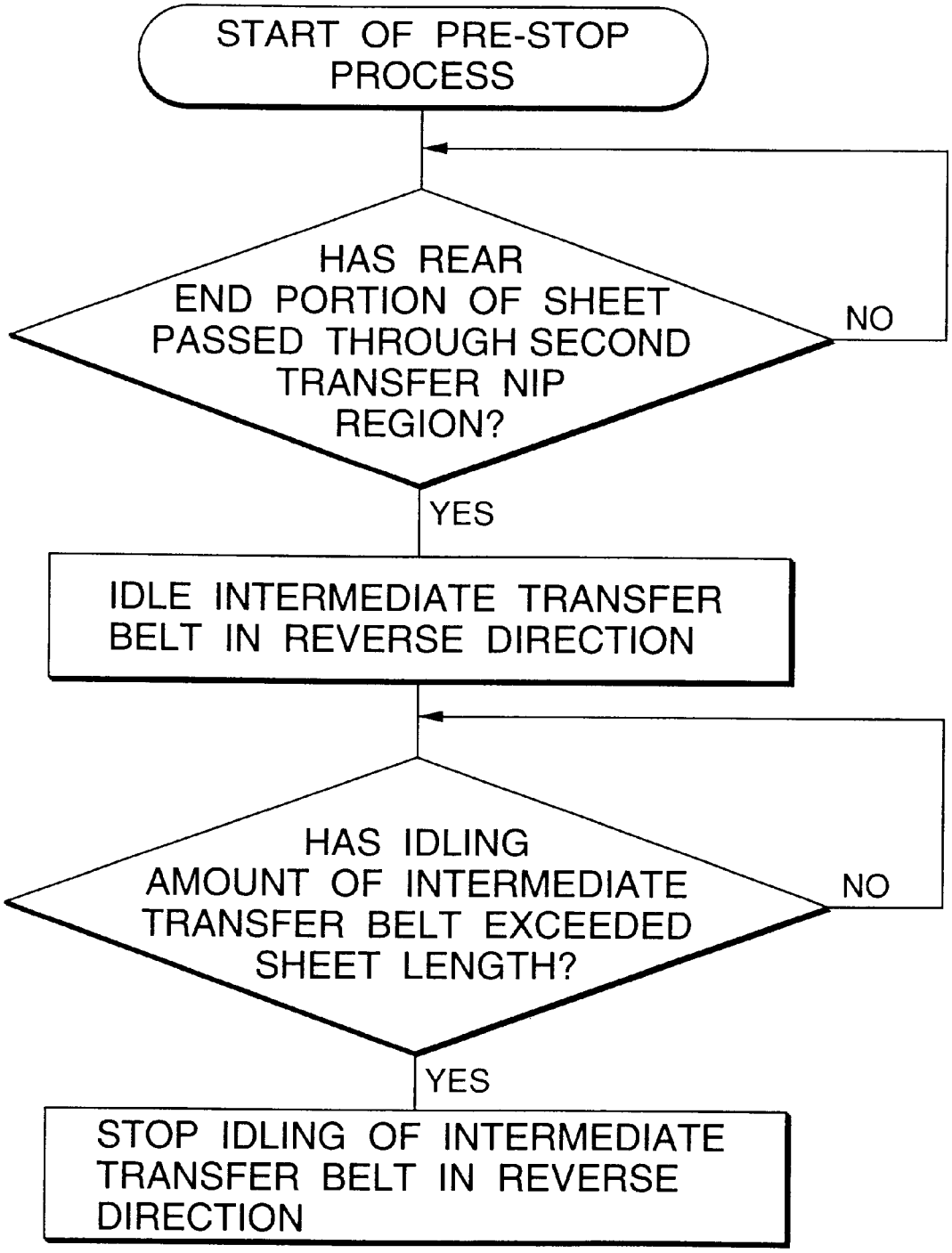
FIG. 22 is a flowchart showing a pre-stop process according to the fifth embodiment.

That is, in the pre-stop process according to this embodiment, as shown in FIG. 22, the intermediate transfer belt 20 starts to be idled in the reverse direction at a time point when the rear end portion of a sheet P has passed through the second transfer nip region. The idling of the intermediate transfer belt 20 in the reverse direction is stopped on condition that the idling amount of the intermediate transfer belt 20 has exceeded the sheet length, for example.

The amount of idling of the intermediate transfer belt 20 in the reverse direction is set properly in such a range that a charged region of the rear end portion of a sheet P that is located downstream of the second transfer nip region and a charged region of the intermediate transfer belt 20 do not influence each other. Specifically, the intermediate transfer belt 20 may be rotated in the reverse direction at least until an inter-image portion reaches a position corresponding to the rear end portion of the sheet P.

Figure 23:
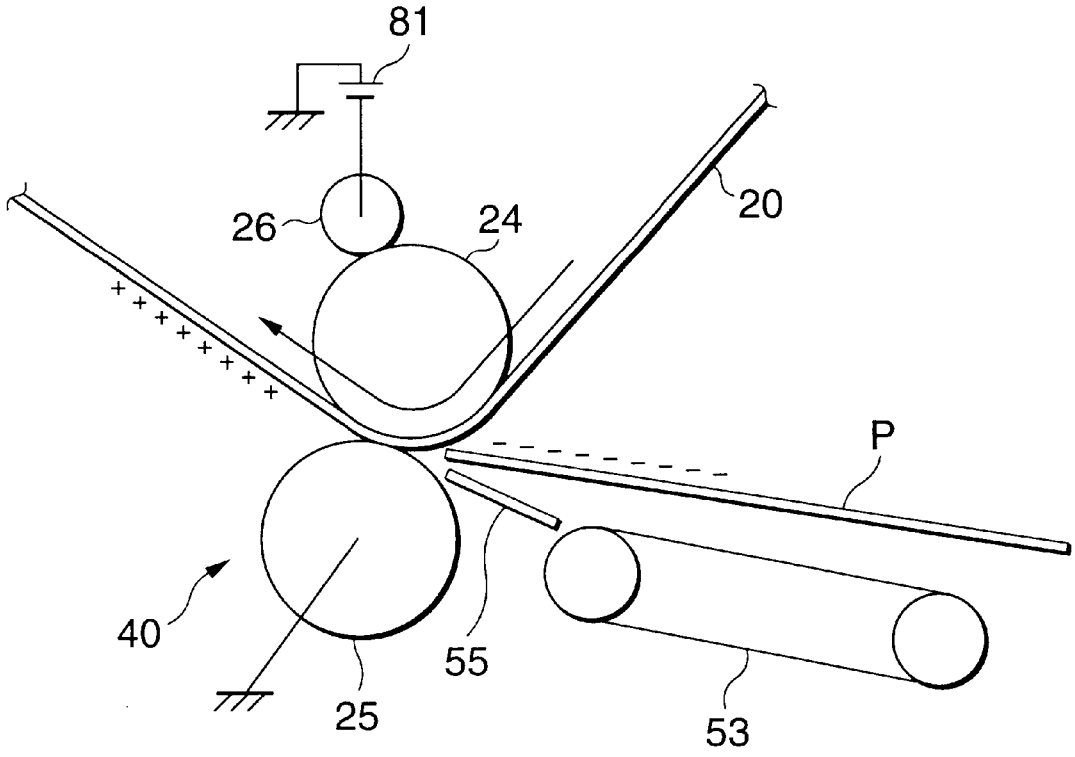
FIG. 23 schematically shows the pre-stop process according to the fifth embodiment.

Therefore, in this embodiment, as shown in FIG. 23, the rear end portion of a sheet that has passed through the second transfer nip region is left negatively charged. However, the idling of the intermediate transfer belt 20 in the reverse direction moves, toward the upstream side of the second transfer nip region, a positively charged region of the intermediate transfer belt 20 that is located downstream of the second transfer nip region. As a result, a positional relationship is established that the negatively charged region of the rear end portion of the sheet P and the positively charged region of the intermediate transfer belt 20 are separated from each other.

At this time, the portion of the intermediate transfer belt 20 that is adjacent to its positively charged region is an inter-image portion to which usually the second transfer bias is not applied. Therefore, the portion of the intermediate transfer belt 20 that is located downstream of the second transfer nip region is rendered in a non-charged state for the inter-image portion.

Therefore, almost no electrostatic attractive force acts between the rear end portion of the sheet P and the intermediate transfer belt 20 in the region downstream of the second transfer nip region, and hence the rear end portion of the sheet P is reliably prevented from sticking to the intermediate transfer belt 20.

As described above, according to the invention, the pre-stop process is executed to prevent a transfer member from re-sticking to the image carrying body even if it is located downstream of and in the vicinity of the transfer position of the collective transfer unit when devices are stopped in a state that an abnormality such as a jam has occurred. Therefore, the event that the rear end portion of a transfer member re-sticks to the image carrying body at the occurrence of an abnormality such as a jam can effectively be prevented.

What is claimed is:

1. A control method of an image forming apparatus, comprising the steps of:

detecting whether a transfer member exists downstream of and in the vicinity of a transfer position of a transfer device when the image forming apparatus is stopped; and if the transfer member exists downstream of and in the vicinity of the transfer position of the transfer device, executing an image formation pre-stop process for preventing the transfer member from sticking to an image carrying body.

2. An image forming apparatus comprising:

an image carrying body for carrying a visible image formed by charged particles;

a transfer device for transferring the visible image on the image carrying body to a transfer member;

a detection device for detecting whether the transfer member exists downstream of and in the vicinity of a transfer position of the transfer device;

an image formation pre-stop processing device for preventing the transfer member from sticking to the image carrying body; and a control device for causing the image formation pre-stop processing device to operate if the transfer member exists downstream of and in the vicinity of the transfer position of the transfer device when image formation is stopped.

3. The image forming apparatus according to claim 2, wherein the image formation pre-stop processing device comprises a member disposed downstream of and in the vicinity of the transfer position of the transfer device and a voltage source for supplying the member with a voltage having the same polarity as a polarity of the charged particles, and wherein the control device performs a control of switching between an operational state and a non-operational state of the voltage source.

4. The image forming apparatus according to claim 3, wherein the member disposed downstream of and in the vicinity of the transfer position of the transfer device also serves as a guide member for guiding a transfer member toward a downstream side of the transfer device.

5. The image forming apparatus according to claim 3, wherein the member disposed downstream of and in the vicinity of the transfer position of the transfer device is a conductive plate.

6. The image forming apparatus according to claim 2, wherein the transfer device is held close to the image carrying body when the visible image on the image carrying body is transferred to the transfer member, and is separated from the image carrying body when the image formation pre-stop processing device operates.

7. An image forming apparatus comprising:

an image carrying body for carrying a visible image formed by charged particles;

a transfer device for transferring the visible image on the image carrying body to a transfer member;

a voltage source for supplying first and second voltages having the same polarity as and a different polarity from a polarity of the charged particles, respectively;

a detection device for detecting whether the transfer member exists downstream of and in the vicinity of a transfer position of the transfer device; and a control device for causing the voltage source to supply the second voltage to the transfer member when the visible image on the image carrying body is transferred to the transfer member, and for causing, if a transfer member exists downstream of and in the vicinity of the transfer position of the transfer device when image formation is stopped, the voltage source to supply the first voltage to the transfer member.

8. The image forming apparatus according to claim 7, wherein the control device further performs a control to hold the transfer device close to the image carrying body when the visible image on the image carrying body is transferred to the transfer member, and to separate the transfer device from the image carrying body when the voltage source supplies the first voltage to the transfer member.

9. An image forming apparatus comprising:

an image carrying body for carrying a visible image formed by charged particles;

a transfer device for transferring the visible image on the image carrying body to a transfer member;

a transport device for transporting the transfer member;

a detection device for detecting whether the transfer member exists downstream of and in the vicinity of a transfer position of the transfer device; and a control device for controlling, if the transfer member exists downstream of and in the vicinity of the transfer position of the transfer device when image formation is stopped, the transport device to transport the transfer member until the transfer member completely passes the transfer position and reaches a position having a prescribed distance from the transfer position.

10. The image forming apparatus according to claim 9, wherein the control device further performs a control to hold the transfer device close to the image carrying body when the visible image on the image carrying body is transferred to the transfer member, and to separate the transfer device from the image carrying body when the control device causes the transport device to transport the transfer member.

11. An image forming apparatus comprising:

an image carrying body for carrying a visible image formed by charged particles;

a transfer device for transferring the visible image on the image carrying body to a transfer member;

a driving device for rotationally driving the image carrying body;

a detection device for detecting whether a transfer member exists downstream of and in the vicinity of a transfer position of the transfer device;

a control device for controlling the driving device to drive the image carrying body for a prescribed time if the transfer member exists downstream of and in the vicinity of the transfer position of the transfer device when image formation is stopped; and wherein the control device controls the driving device to drive the image carrying body in a rotational direction that is reverse to that during the image formation.

12. The image forming apparatus according to claim 11, wherein the control device further performs a control to hold the transfer device close to the image carrying body when the visible image on the image carrying body is transferred to the transfer member, and to separate the transfer device from the image carrying body when the control device causes the driving device to drive the image carrying body.

13. An image forming apparatus comprising:

an image carrying body for carrying a visible image formed by charged particles;

a transfer device for transferring the visible image on the image carrying body to a transfer member;

a judgment device for judging whether the transfer member is in a condition to be prone to stick to the image carrying body;

an image formation pre-stop processing device for preventing the transfer member from sticking to the image carrying body; and a control device for causing the image formation pre-stop processing device to operate if the transfer member is in the condition to be prone to stick to the image carrying body when the image forming apparatus is stopped.

14. The image forming apparatus according to claim 13, wherein the judgment device comprises a humidity detecting device, and makes the judgment based on a detection result of the humidity detecting device.

15. The image forming apparatus according to claim 13, wherein the judgment device comprises a double-sided image formation judgment device for judging whether an image is already formed on a back transfer surface of the transfer member, and makes the judgment based on a detection result of the double-sided image formation judgment device.

16. The image forming apparatus according to claim 13, wherein the judgment device comprises a detection device for detecting a type of the transfer member, and makes the judgment based on a detection result of the detection device.

17. A control method of an image forming apparatus, comprising the steps of:

judging whether a transfer member is in a condition to be prone to stick to an image carrying body; and executing an image formation pre-stop process for preventing the transfer member from sticking to the image carrying body if the transfer member is in the condition to be prone to stick to the image carrying body when the image forming apparatus is stopped.

* * * * *